US006604803B1

(12) United States Patent
Hanabusa et al.

(10) Patent No.: US 6,604,803 B1
(45) Date of Patent: Aug. 12, 2003

(54) PRINTER WHICH COMPENSATES FOR PAPER UNEVENNESS

(75) Inventors: Tadashi Hanabusa, Kanagawa (JP); Akitoshi Yamada, Kanagawa (JP); Akihiko Hamamoto, Irvine, CA (US); Masashi Kamada, Irvine, CA (US); Hiromitsu Hirabayashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 181 days.

(21) Appl. No.: 09/660,355

(22) Filed: Sep. 12, 2000

(51) Int. Cl.[7] ..... B41J 29/38

(52) U.S. Cl. ..... 347/14

(58) Field of Search ..... 347/14, 19, 43, 347/9, 101, 104; 358/1, 2

(56) References Cited

U.S. PATENT DOCUMENTS

| | | | | |
|---|---|---|---|---|
| 3,886,862 | A | 6/1975 | Hamisch, Jr. | 101/109 |
| 4,843,338 | A | 6/1989 | Rasmussen et al. | 346/140 R |
| 4,872,026 | A | 10/1989 | Rasmussen et al. | 346/140 R |
| 4,951,067 | A | 8/1990 | Spehrley, Jr. | 346/140 R |
| 4,965,612 | A | 10/1990 | Sakaki et al. | 346/1.1 |
| 5,041,846 | A | 8/1991 | Vincent et al. | 346/25 |
| 5,043,741 | A | 8/1991 | Spehrley, Jr. | 346/1.1 |
| 5,356,229 | A | 10/1994 | Hickman et al. | 400/642 |
| 5,393,151 | A | 2/1995 | Martin et al. | 400/642 |
| 5,419,644 | A | 5/1995 | Martin et al. | 400/642 |
| 5,510,822 | A | 4/1996 | Vincent et al. | 347/102 |
| 5,519,425 | A | 5/1996 | Dietl et al. | 347/87 |
| 5,563,643 | A | 10/1996 | Carlotta et al. | 347/87 |
| 5,576,744 | A | 11/1996 | Niikura et al. | 347/14 |
| 5,644,343 | A | 7/1997 | Allen | 347/17 |
| 5,650,808 | A | 7/1997 | Vincent et al. | 347/43 |
| 5,673,069 | A | 9/1997 | Canfield et al. | 347/15 |
| 5,736,995 | A | 4/1998 | Bohorquez et al. | 347/14 |
| 5,751,303 | A | 5/1998 | Erickson et al. | 347/16 |
| 5,764,263 | A | 6/1998 | Lin | 347/101 |
| 5,812,152 | A | 9/1998 | Torigoe et al. | 347/2 |
| 5,820,283 | A | 10/1998 | Sunada et al. | 400/642 |
| 5,825,377 | A | 10/1998 | Gotoh et al. | 347/15 |
| 5,838,338 | A | 11/1998 | Olson | 347/8 |
| 5,847,719 | A | 12/1998 | Yamaguchi et al. | 346/134 |
| 5,861,895 | A | 1/1999 | Tajika et al. | 347/14 |
| 5,864,349 | A | 1/1999 | Hirabayashi et al. | 347/39 |
| 5,864,350 | A | 1/1999 | Shioya et al. | 347/40 |
| 5,874,979 | A | 2/1999 | Ohyama | 347/104 |
| 5,894,314 | A | 4/1999 | Tajika et al. | 347/14 |
| 5,896,143 | A | 4/1999 | Matsui et al. | 347/24 |
| 5,898,449 | A | 4/1999 | Narang et al. | 347/87 |
| 5,907,342 | A | 5/1999 | Sakaki et al. | 347/105 |

(List continued on next page.)

FOREIGN PATENT DOCUMENTS

| | | |
|---|---|---|
| EP | 0925928 | 6/1999 |

*Primary Examiner*—Lamson Nguyen
*Assistant Examiner*—K. Feggins
(74) *Attorney, Agent, or Firm*—Fitzpatrick, Cella, Harper & Scinto

(57) ABSTRACT

Control of an ink ejection frequency to compensate for recording medium unevenness in printing by inducing a predetermined unevenness pattern into a recording medium, adjusting an ink ejection frequency of a print head based on the induced unevenness pattern, and controlling ink ejection based on the adjusted frequency. A plurality of print heads may be employed that may correspond to different color inks and may be controlled by a same control signal or individually. Control may also be varied for bi-directional printing based on a printing direction. The adjustment of the ink ejection frequency may be providing a predetermined recording unevenness pattern having periodic oscillations, dividing each periodic oscillation into a predetermined number of regions, setting a number of ink droplets to be ejected within each region, determining a gate array interval for each region, providing at least one parameter corresponding to a printing operation, and determining an ink ejection trigger difference for each ink droplet to be ejected within each region.

40 Claims, 20 Drawing Sheets

U.S. PATENT DOCUMENTS 5,907,666 A 5/1999 Yano et al. ..... 395/109
5,960,161 A 9/1999 Bloomberg et al. ..... 395/109
5,992,962 A 11/1999 Yen et al. ..... 347/9
6,000,781 A 12/1999 Akiyama et al. ..... 347/40
6,020,906 A 2/2000 Adams et al. ..... 347/217
6,027,211 A 2/2000 Unosawa et al. ..... 347/104
6,068,373 A 5/2000 Chen et al. ..... 347/105
6,084,604 A 7/2000 Moriyama et al. ..... 347/15
6,331,042 B1 12/2001 Yamada ..... 347/19
6,352,327 B1 3/2002 Yano et al. ..... 347/14
6,359,701 B1 3/2002 Yamada et al. ..... 358/1.2
6,364,452 B1 4/2002 Noyes et al. ..... 347/43

| | | BLOCK 0 | BLOCK 1 | BLOCK 2 | BLOCK 3 |
|---|---|---|---|---|---|
| FORWARD SCAN | ΔFWD | B=0 | ——— | A=+(0.5)PIX | ——— |
| | INTERVAL (GA_ATTRGPER) | 1334 | $1334 + \alpha$ | 1334 | $1334 - \alpha$ |
| | ATTRGDelay | B=0 | $(X_2 - X_1 - 150) \times (A - B) \div 180$ | A=+(0.5)PIX | $(X_1 + 720 - X_3) \times (A - B) \div 180$ |
| REVERSE SCAN | ΔREV | D=0 | ——— | C=-(0.5)PIX | ——— |
| | INTERVAL (GA_ATTRG PER) | 1334 | $1334 - \beta$ | 1334 | $1334 + \beta$ |
| | ATTRGDelay | D=0 | $(X_2 - X_1 - 150) \times (C - D) \div 180$ | C=-(0.5)PIX | $(X_1 + 720 - X_3) \times (C - D) \div 180$ |
| | $\alpha$ | | $\frac{1334}{180} \times (A - B)$ | ——— | $\frac{1334}{180} \times (A - B)$ |
| | $\beta$ | | $\frac{1334}{180} \times (C - D)$ | ——— | $\frac{1334}{180} \times (C - D)$ |

FIG. 18

| | | BLOCK 0 | BLOCK 1 | BLOCK 2 | BLOCK 3 |
|---|---|---|---|---|---|
| FORWARD SCAN | ΔFWD | B=0 | ——— | $A=-(0.5)_{PIX}$ | ——— |
| | INTERVAL (GA_ATTRGPER) | 1334 | $1334 - \alpha$ | 1334 | $1334 + \alpha$ |
| | ATTRGDelay | B=0 | $-\{(X_2 - X_1 - 150) \times \lvert A - B \rvert \div 180\}$ | $A=-(0.5)_{PIX}$ | $-\{(X_1 + 720 - X_3) \times \lvert A - B \rvert \div 180\}$ |
| REVERSE SCAN | ΔREV | D=0 | ——— | $C=+(0.5)_{PIX}$ | ——— |
| | INTERVAL (GA_ATTRG PER) | 1334 | $1334 + \beta$ | 1334 | $1334 - \beta$ |
| | ATTRGDelay | D=0 | $-\{(X_2 - X_1 - 150) \times \lvert C - D \rvert \div 180\}$ | $C=+(0.5)_{PIX}$ | $-\{(X_1 + 720 - X_3) \times \lvert C - D \rvert \div 180\}$ |
| | $\alpha$ | | $\frac{1334}{180} \times \lvert A - B \rvert$ | ——— | $\frac{1334}{180} \times \lvert A - B \rvert$ |
| | $\beta$ | | $\frac{1334}{180} \times \lvert C - D \rvert$ | ——— | $\frac{1334}{180} \times \lvert C - D \rvert$ |

FIG. 25

PRINTER WHICH COMPENSATES FOR PAPER UNEVENNESS

BACKGROUND OF THE INVENTION

1. Field of the Invention

The present invention relates to compensation for recording medium unevenness during printing operations. More specifically, the present invention relates to control over timing of ink droplet ejection to compensate for recording medium unevenness.

2. Description of the Related Art

Recording medium (paper) unevenness is a known phenomena in ink-jet printing operations. The recording medium unevenness (sometimes called "cockling") is caused by excessive wetting of the paper by the liquid ink. The cockling introduces an unknown waveform shape into the paper that causes problems during printing operations, such as interference with a recording head during scanning. That is, high spots in the waveform shape of the paper interfere or rub against the recording head as it scans across the paper. The interference can cause problems such as clogging of the ink nozzles on the recording head and smearing of the ink.

To minimize interference problems caused by cockling, it has been proposed to apply pressure to the paper ahead of the recording head as it scans across the paper. One way this has been done is to provide a smaller roller on the printer carriage ahead of the print head such that, as the roller scans across the paper, the roller flattens the uneven paper ahead of the print head. However, the roller only slightly reduces the amount of cockling in the paper and after the roller flattens the paper, the paper tends to return to its uneven condition. Therefore, although the roller somewhat reduces the possibility of interference with the recording head, other problems associated with paper cockling still exist.

Another problem associated with paper cockling is image roughness that is caused by an uneven spacing of the ink droplets as they contact the paper. The ink droplet spacing is dependent upon several factors, including the carriage speed, the ink ejection speed and the distance between the print head and the paper. As seen in FIGS. 13A and 13B, ink droplets are ejected by the recording head at a constant frequency (f) along the scan direction. If the paper is flat or at least very close to being flat as seen in FIG. 13A, the ink droplets contact the paper at approximately the same spacing (d). However, when cockling occurs in the paper and the paper takes on a waveform shape as seen in FIG. 13B, the ink droplets do not contact the paper with a constant spacing, but rather they contact the paper with a different and varying spacing. That is, although the ink droplets are ejected by the recording head at a constant frequency f, the waveform shape of the paper causes some of the ink droplets to contact the paper in a more narrow pattern (d1) than they were ejected at, and some of the ink droplets to contact the paper in a wider pattern (d2) than they were ejected at. Thus, the waveform shape effects the contact frequency because of the varying distance between the print head and the paper. As a result, even though the ink droplets were ejected at a constant frequency, the spacing between the ink droplets contacting the paper is not the same as the spacing frequency that they were ejected at and image roughness occurs.

This problem is made worse in bi-directional printing modes. In bi-directional printing, a line of ink droplets is printed in a forward scan of the recording head, the paper is advanced one line and then another line of ink droplets is printed in a reverse scan of the recording head. Therefore, in bi-directional scanning, the ink droplet frequency contacting the recording medium varies from line to line, which makes the image roughness even worse than unidirectional scanning.

SUMMARY OF THE INVENTION

The present invention addresses the foregoing by inducing a predetermined unevenness pattern into the recording medium and adjusting the frequency of ink droplet ejection based on the induced pattern. As a result, a known unevenness pattern is induced into the recording medium and the ink ejection frequency can be adjusted to compensate for the known unevenness pattern. Therefore, ink droplets contact the recording medium in a more even spacing along a scan direction and image density roughness that would otherwise occur is reduced.

Accordingly, in one aspect the invention may be inducing a predetermined unevenness pattern into a recording medium, adjusting an ink ejection frequency of a print head based on the induced unevenness pattern, and controlling ink ejection based on the adjusted frequency.

The invention may be implemented with multiple print heads and in bi-directional printing. Each print head can be controlled by the same control signal, or individually based on the color of ink that the print head ejects, as well as based on whether the print head is scanning in a forward or reverse direction.

Each print head can be controlled with the same control signal, especially if the print heads are spaced relative to one another a distance corresponding to the spacing between the cockling ribs. Spacing the print heads relative to one another a distance corresponding to the distance between the cockling ribs allows both color and black print data can be compensated for accordingly with the same control signal. However, if the print heads are not spaced relative to one another a distance corresponding the distance between the cockling ribs, then if color and black data are to be printed, the color print head may be controlled, and if only black data is to be printed, the black print head can be controlled. Additionally, bi-directional compensation can be provided for, thereby resulting in less density unevenness of mixed color images as well as bi-directional printed images.

The invention may further provide for automatically setting parameters utilized in adjusting the ink ejection frequency based on a selected printing mode. The parameters used in adjusting the frequency can be set based on, for example, whether a single pass or a multi-pass printing mode is selected, the paper type selected (i.e. plain paper, high resolution paper, etc.), and the ink density (i.e. darkness and brightness).

In another aspect, the invention may be adjusting an ink ejection frequency in an ink-jet printer by providing a predetermined recording unevenness pattern having periodic oscillations, dividing each periodic oscillation into a predetermined number of regions, setting a number of ink droplets to be ejected within each region, determining a gate array interval for each region, providing at least one parameter corresponding to a printing operation, and determining an ink ejection trigger difference for each ink droplet to be ejected within each region.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

FIG. 18 is a table of formulas for calculating a firing frequency and an auto trigger delay according to the invention.

FIG. 25 is a table of formulas for calculating a firing frequency and an auto trigger delay according to a second embodiment of the invention.

DETAILED DESCRIPTION OF THE PREFERRED EMBODIMENTS

Figure 1:
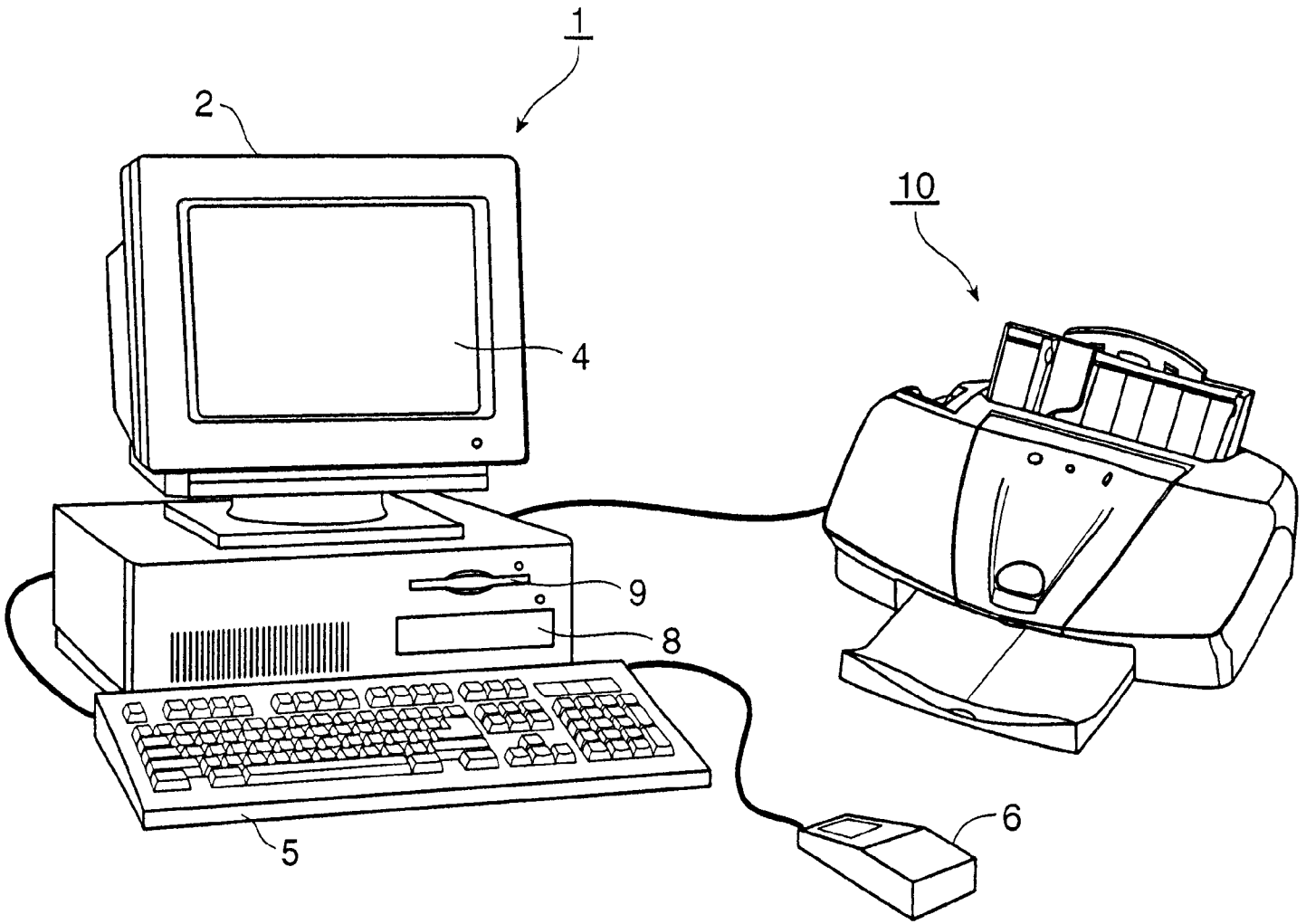
FIG. 1 shows a perspective view of computing equipment used in connection with the printer of the present invention.

FIG. 1 is a view showing the outward appearance of computing equipment used in connection with the invention described herein. Computing equipment 1 includes host processor 2. Host processor 2 comprises a personal computer (hereinafter "PC"), preferably an IBM PC-compatible computer having a windowing environment, such as Microsoft® Windows95. Provided with computing equipment 1 are display 4 comprising a color monitor or the like, keyboard 5 for entering text data and user commands, and pointing device 6. Pointing device 6 preferably comprises a mouse for pointing and for manipulating objects displayed on display 4.

Computing equipment 1 includes a computer-readable memory medium, such as fixed computer disk 8, and floppy disk interface 9. Floppy disk interface 9 provides a means whereby computing equipment 1 can access information, such as data, application programs, etc., stored on floppy disks. A similar CD-ROM interface (not shown) may be provided with computing equipment 1, through which computing equipment 1 can access information stored on CD-ROMs.

Disk 8 stores, among other things, application programs by which host processor 2 generates files, manipulates and stores those files on disk 8, presents data in those files to an operator via display 4, and prints data in those files via printer 10. Disk 8 also stores an operating system which, as noted above, is preferably a windowing operating system such as Windows95. Device drivers are also stored in disk 8. At least one of the device drivers comprises a printer driver which provides a software interface to firmware in printer 10. Data exchange between host processor 2 and printer 10 is described in more detail below.

Figure 2:
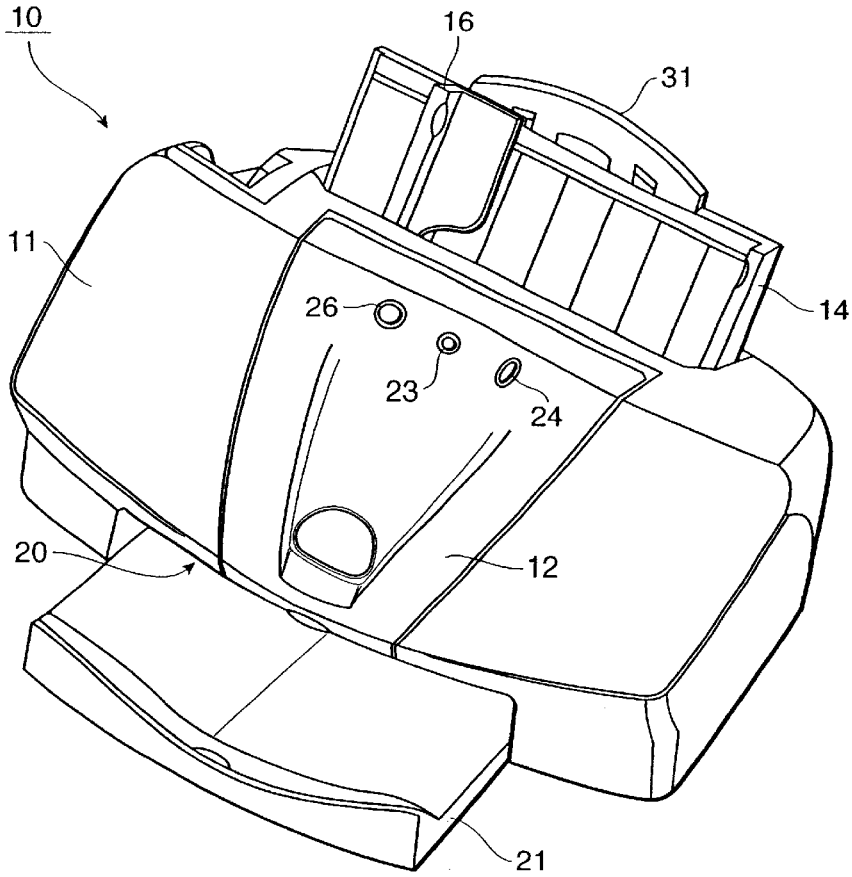
FIG. 2 is a front perspective view of the printer shown in FIG. 1.
Figure 3:
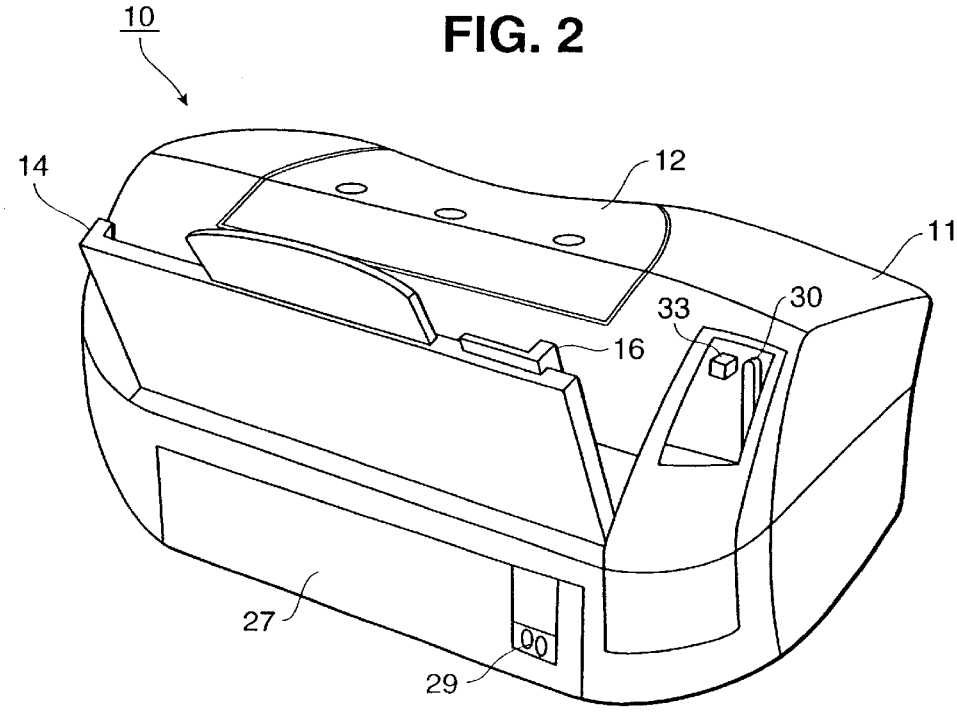
FIG. 3 is a back perspective view of the printer shown in FIG. 1.

FIGS. 2 and 3 show perspective front and back views, respectively, of printer 10. As shown in FIGS. 2 and 3, printer 10 includes housing 11, access door 12, automatic feeder 14, automatic feed adjuster 16, media eject port 20, ejection tray 21, power source 27, power cord connector 29, parallel port connector 30 and universal serial bus (USB) connector 33.

Housing 11 houses the internal workings of printer 10, including a print engine which controls the printing operations to print images onto recording media. Included on housing 11 is access door 12. Access door 12 is manually openable and closeable so as to permit a user to access the internal workings of printer 10 and, in particular, to access ink tanks installed in printer 10 so as to allow the user to change or replace the ink tanks as needed. Access door 12 also includes indicator light 23, power on/off button 26 and resume button 24. Indicator light 23 may be an LED that lights up to provide an indication of the status of the printer, i.e. powered on, a print operation in process (blinking), or a failure indication. Power on/off button 26 may be utilized to turn the printer on and off and resume button 24 may be utilized to reset an operation of the printer.

As shown in FIGS. 2 and 3, automatic feeder 14 is also included on housing 11 of printer 10. Automatic feeder 14 defines a media feed portion of printer 10. That is, automatic feeder 14 stores recording media onto which printer 10 prints images. In this regard, printer 10 is able to print images on a variety of types of recording media. These types include, but are not limited to, plain paper, high resolution paper, transparencies, glossy paper, glossy film, back print film, fabric sheets, T-shirt transfers, bubble jet paper, greeting cards, brochure paper, banner paper, thick paper, etc.

During printing, individual sheets which are stacked within automatic feeder 14 are fed from automatic feeder 14 through printer 10. Automatic feeder 14 includes automatic feed adjuster 16. Automatic feed adjuster 16 is laterally movable to accommodate different media sizes within automatic feeder 14. These sizes include, but are not limited to, letter, legal, A4, B5 and envelope. Custom-sized recording media can also be used with printer 10. Automatic feeder 14 also includes backing 31, which is extendible to support recording media held in automatic feeder 14. When not in use, backing 31 is stored within a slot in automatic feeder 14, as shown in FIG. 2.

As noted above, media are fed through printer 10 and ejected from eject port 20 into ejection tray 21. Ejection tray 21 extends outwardly from housing 11 as shown in FIG. 2 and provides a receptacle for the recording media upon ejection for printer 10. When not in use, ejection tray 21 may be stored within printer 10.

Power cord connector 29 is utilized to connect printer 10 to an external AC power source. Power supply 27 is used to convert AC power from the external power source, and to supply the converted power to printer 10. Parallel port 30 connects printer 10 to host processor 2. Parallel port 30 preferably comprises an IEEE-1284 bi-directional port, over which data and commands are transmitted between printer 10 and host processor 2. Alternatively, data and commands can be transmitted to printer 10 through USB port 33.

Figure 4:
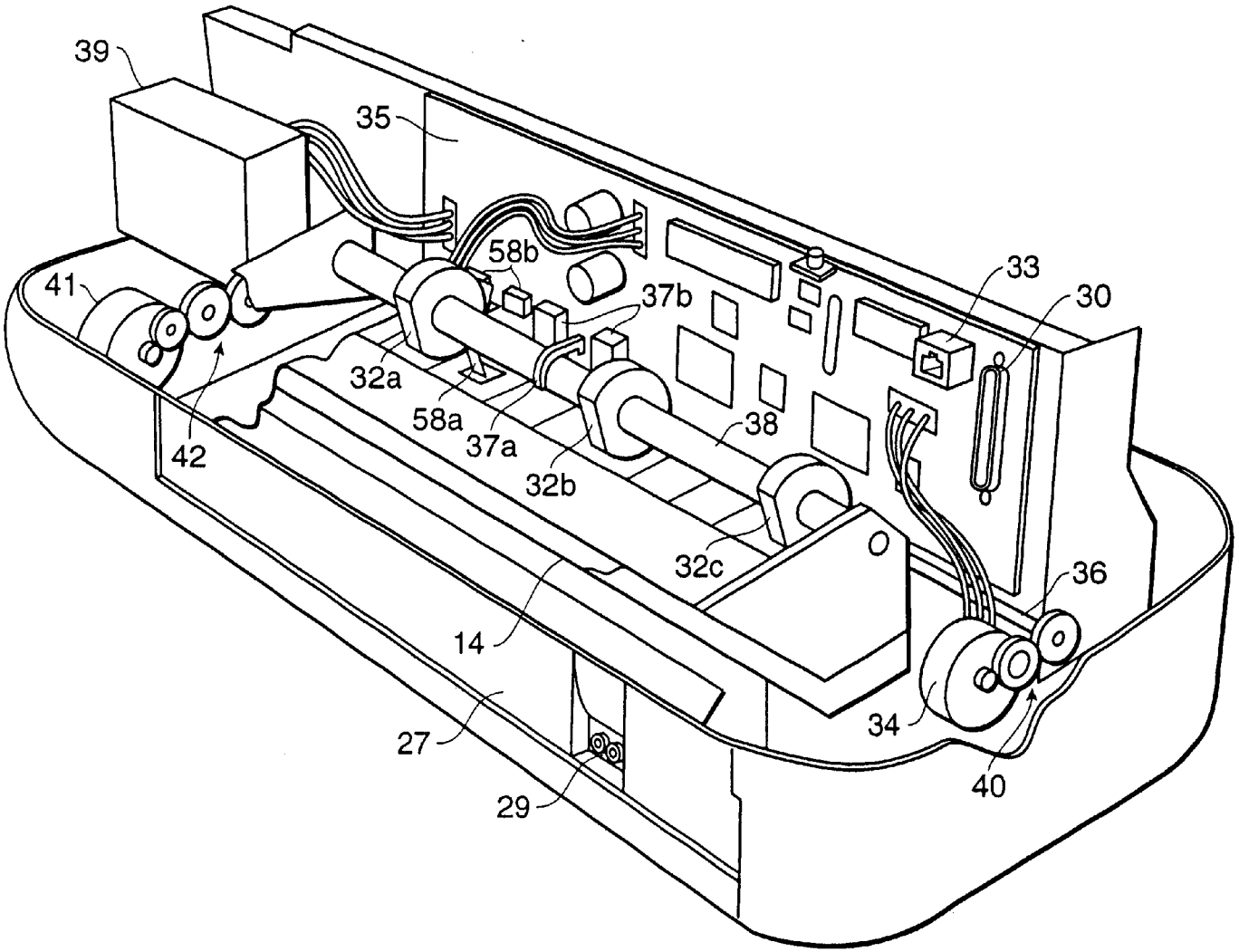
FIG. 4 is a back, cut-away perspective view of the printer shown in FIG. 1.
Figure 5:
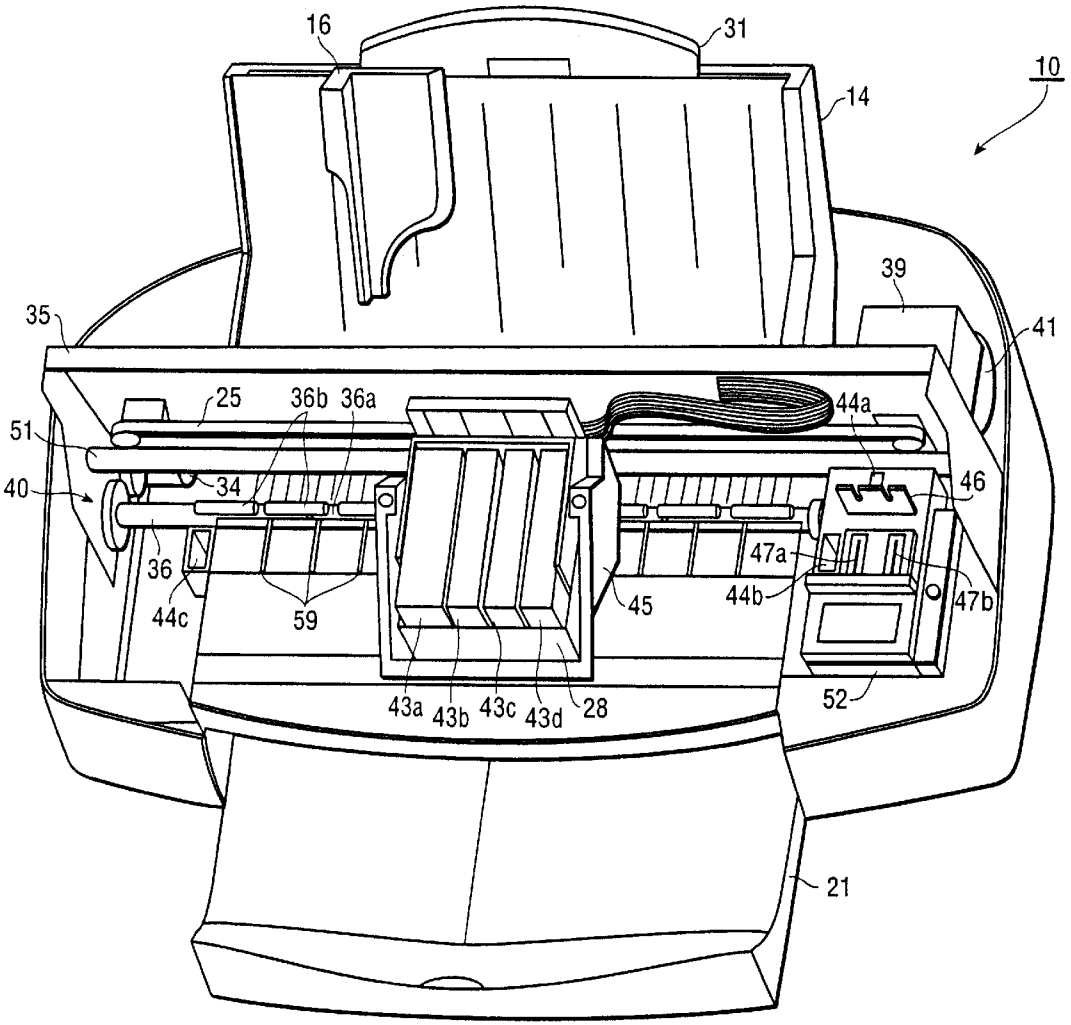
FIG. 5 is a front, cut-away perspective view of the printer shown in FIG. 1.

FIGS. 4 and 5 show back and front cut-away perspective views, respectively, of printer 10. As shown in FIG. 4, printer 10 includes an automatic sheet feed assembly (ASF) that comprises automatic sheet feeder 14, ASF rollers 32*a*, 32*b* and 32*c* attached to ASF shaft 38 for feeding media from automatic feeder 14. ASF shaft 38 is driven by drive train assembly 42. Drive train assembly 42 is made up of a series of gears that are connected to and driven by ASF motor 41. Drive train assembly 42 is described in more detail below with reference to FIGS. 6A and 6B. ASF motor 41 is preferably a stepper motor that rotates in stepped increments (pulses). Utilization of a stepper motor provides the ability for a controller incorporated in circuit board 35 to count the number of steps the motor rotates each time the ASF is actuated. As such, the position of the ASF rollers at any instant can be determined by the controller. ASF shaft 38 also includes an ASF initialization sensor tab 37*a*. When the ASF shaft is positioned at a home position (initialization position), tab 37*a* is positioned between ASF initialization sensors 37*b*. Sensors 37*b* are light beam sensors, where one is a transmitter and the other a receiver such that when tab 37*a* is positioned between sensors 37*b*, tab 37*a* breaks continuity of the light beam, thereby indicating that the ASF is at the home position.

Also shown in FIG. 4 is a page edge (PE) detector lever 58*a* and PE sensors 58*b*. PE sensors 58*b* are similar to ASF initialization sensors 37*b*. That is, they are light beam sensors. PE lever 58*a* is pivotally mounted and is actuated by a sheet of the recording medium being fed through the printer 10. When no recording medium is being fed through printer 10, lever 58*a* is at a home position and breaks continuity of the light beam between sensors 58*b*. As a sheet of the recording medium begins to be fed through the printer by the ASF rollers, the leading edge of the recording medium engages PE lever 58*a* pivotally moving the lever to allow continuity of the light beam to be established between sensors 58*b*. Lever 58*a* remains in this position while the recording medium is being fed through printer 10 until the trailing edge of the recording medium reaches PE lever 58*a*, thereby disengaging lever 58*a* from the recording medium and allowing lever 58*a* to return to its home position to break the light beam. The PE sensor is utilized in this manner to sense when a page of the recording medium is being fed through the printer and the sensors provide feedback of such to a controller on circuit board 35.

Figure 6A:
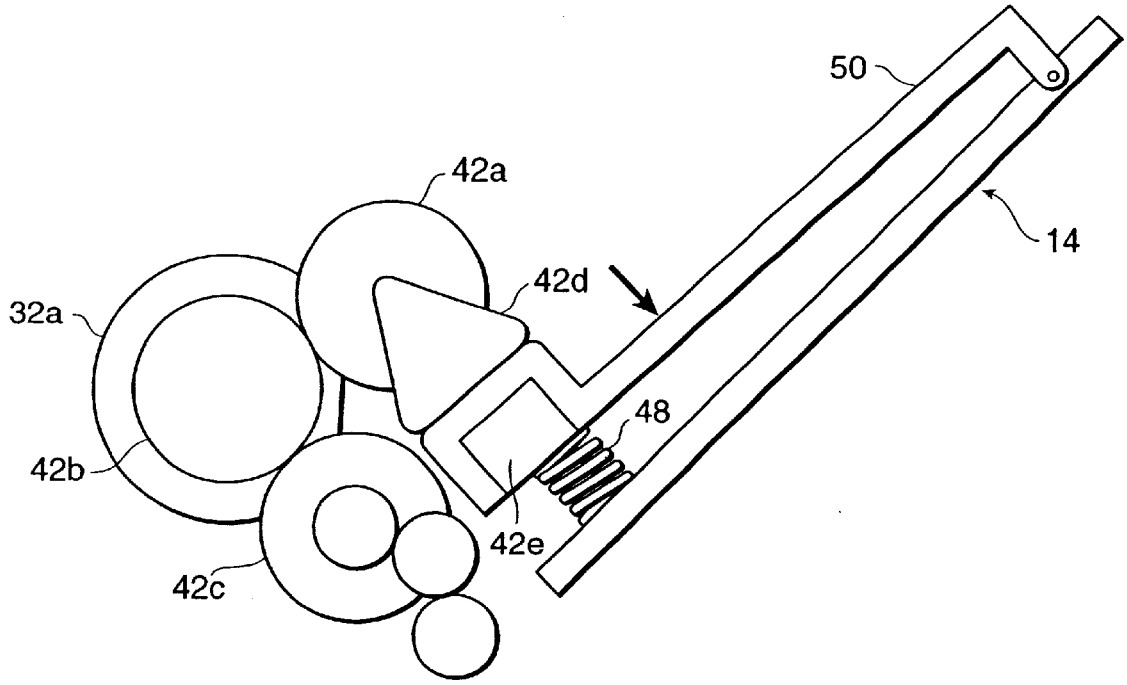
FIGS. 6A and 6B show a geartrain configuration for an automatic sheet feeder of the printer shown in FIG. 1.
Figure 6B:
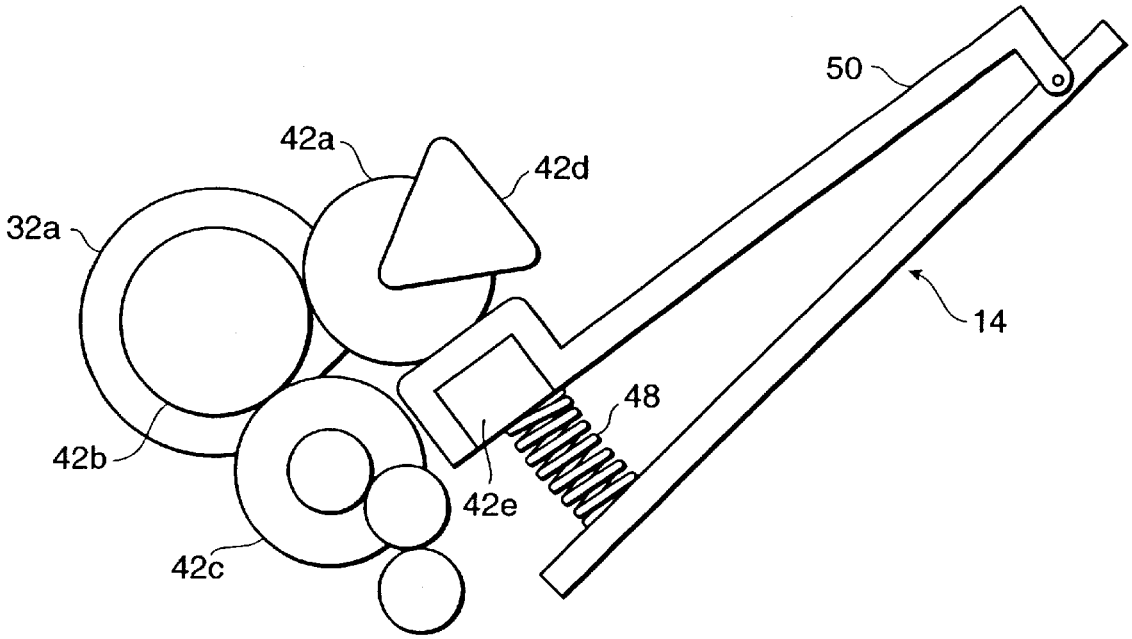

ASF gear train assembly 42 may appear as shown in FIGS. 6A and 6B. As shown in FIG. 6A, gear train assembly 42 comprises gears 42*a*, 42*b* and 42*c*. Gear 42*b* is attached to the end of ASF shaft 38 and turns the shaft when ASF motor 41 is engaged. Gear 42*a* engages gear 42*b* and includes a cam 42*d* that engages an ASF tray detent arm 42*e* of automatic feeder 14. As shown in FIG. 6A, when ASF shaft 38 is positioned at the home position, cam 42*d* presses against detent arm 42*e*. Automatic feeder 14 includes a pivotally mounted plate 50 that is biased by spring 48 so that when cam 42*d* engages detent arm 42*e*, automatic feeder 14 is depressed and when cam 42*d* disengages detent arm 42*e* (such as that shown in FIG. 6B), plate 50 is released. Depressing detent arm 42*e* causes the recording media stacked in automatic feeder 14 to move away from ASF rollers 32*a*, 32*b* and 32*c* and releasing detent arm 42*e* allows the recording to move close to the rollers so that the rollers can engage the recording medium when the ASF motor is engaged.

Returning to FIG. 4, printer 10 includes line feed motor 34 that is utilized for feeding the recording medium through printer 10 during printing operations. Line feed motor 34 drives line feed shaft 36, which includes line feed pinch rollers 36*a*, via line feed geartrain 40. The geartrain ratio for line feed geartrain 40 is set to advance the recording medium a set amount for each pulse of line feed motor 34. The ratio may be set so that one pulse of line feed motor 34 results in a line feed amount of the recording medium equal to a one pixel resolution advancement of the recording medium. That is, if one pixel resolution of the printout of printer 10 is 600 dpi (dots per inch), the geartrain ratio may be set so that one pulse of line feed motor 34 results in a 600 dpi advancement of the recording medium. Alternatively, the ratio may be set so that each pulse of the motor results in a line feed amount that is equal to a fractional portion of one pixel resolution rather than being a one-to-one ratio. Line feed motor 34 preferably comprises a 200-step, 2 phase pulse motor and is controlled in response to signal commands received from circuit board 35. Of course, line feed motor 34 is not limited to a 200-step 2 phase pulse motor and any other type of line feed motor could be employed, including a DC motor with an encoder.

As shown in FIG. 5, printer 10 is a single cartridge printer which prints images using dual print heads, one having nozzles for printing black ink and the other having nozzles for printing cyan, magenta and yellow inks. Specifically, carriage 45 holds cartridge 28 that preferably accommodates ink tanks 43*a*, 43*b*, 43*c* and 43*d*, each containing a different colored ink. A more detailed description of cartridge 28 and ink tanks 43*a* to 43*d* is provided below with regard to FIG. 7. Carriage 45 is driven by carriage motor 39 in response to signal commands received from circuit board 35. Specifically, carriage motor 39 controls the motion of belt 25, which in turn provides for horizontal translation of carriage 45 along carriage guide shaft 51. In this regard, carriage motor 39 provides for bi-directional motion of belt 25, and thus of carriage 45. By virtue of this feature, printer 10 is able to perform bi-directional printing, i.e. print images from both left to right and right to left.

Printer 10 preferably includes recording medium cockling ribs 59. Ribs 59 induce a desired cockling pattern into the recording medium which the printer can compensate for by adjusting the firing frequency of the print head nozzles. Ribs 59 are spaced a set distance apart, depending upon the desired cockling shape. The distance between ribs 59 may be based on motor pulses of carriage motor 39. That is, ribs 59 may be positioned according to how many motor pulses of carriage motor 39 it takes for the print head to reach the location. For example, ribs 59 may be spaced in 132 pulse increments.

Printer 10 also preferably includes pre-fire receptacle areas 44*a*, 44*b* and 44*c*, wiper blade 46, and print head caps 47*a* and 47*b*. Receptacles 44*a* and 44*b* are located at a home position of carriage 45 and receptacle 44*c* is located outside of a printable area and opposite the home position. At desired times during printing operations, a print head pre-fire operation may be performed to eject a small amount of ink from the print heads into receptacles 44*a*, 44*b* and 44*c*. Wiper blade 46 is actuated to move with a forward and backward motion relative to the printer. When carriage 45 is moved to its home position, wiper blade 46 is actuated to move forward and aft so as to traverse across each of the print heads of cartridge 28, thereby wiping excess ink from the print heads. Print head caps 47*a* and 47*b* are actuated in a relative up and down motion to engage and disengage the print heads when carriage 45 is at its home position. Caps 47*a* and 47*b* are actuated by ASF motor 41 via a geartrain (not shown). Caps 47*a* and 47*b* are connected to a rotary pump 52 via tubes (not shown). Pump 52 is connected to line feed shaft 36 via a geartrain (not shown) and is actuated by running line feed motor 34 in a reverse direction. When caps 47*a* and 47*b* are actuated to engage the print heads, they form an airtight seal such that suction applied by pump 52 through the tubes and caps 47*a* and 47*b* sucks ink from the print head nozzles through the tubes and into a waste ink container (not shown). Caps 47*a* and 47*b* also protect the nozzles of the print heads from dust, dirt and debris.

Figure 7:
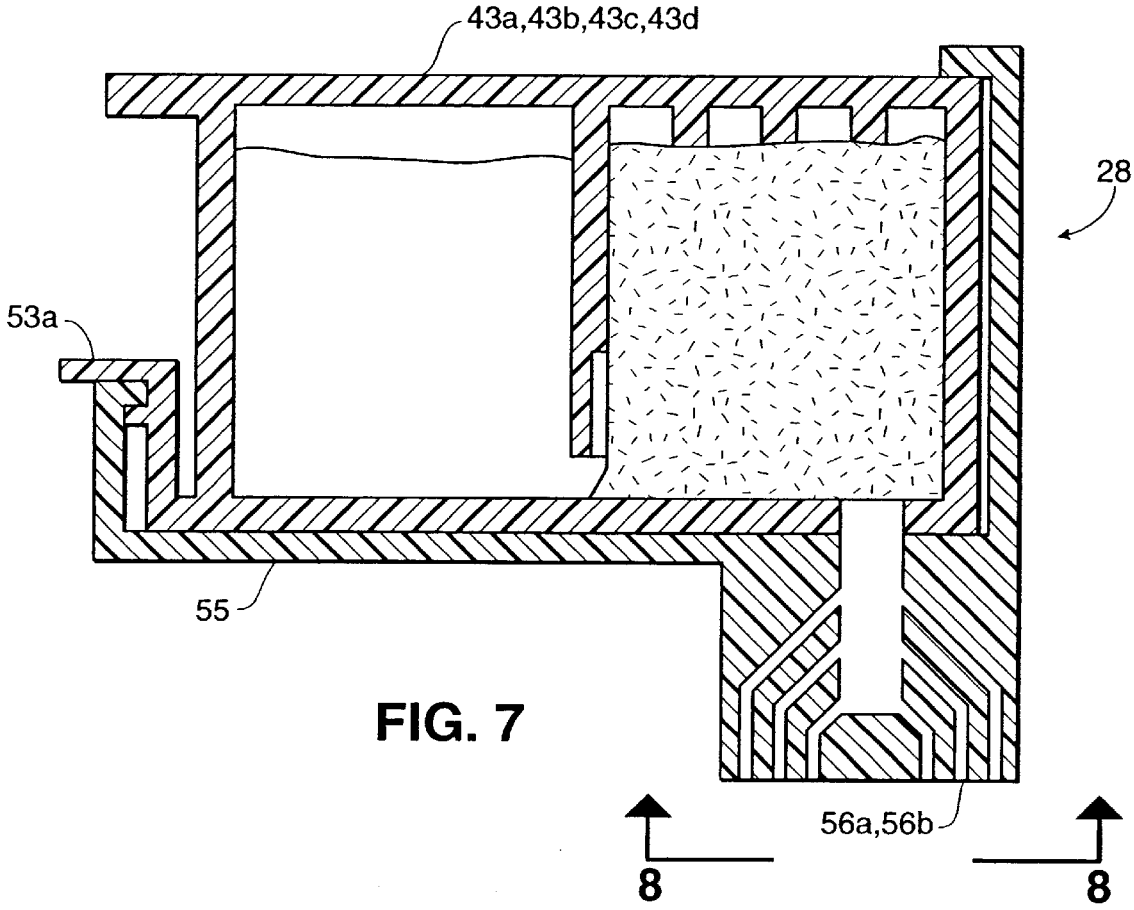
FIG. 7 is a cross-section view through a print cartridge and ink tank of the printer of FIG. 1.

FIG. 7 is a cross section view through one of the ink tanks installed in cartridge 28. Ink cartridge 28 includes cartridge housing 55, print heads 56*a* and 56*b*, and ink tanks 43*a*, 43*b*, 43*c* and 43*d*. Cartridge body 28 accommodates ink tanks 43*a* to 43*d* and includes ink flow paths for feeding ink from each of the ink tanks to either of print heads 56*a* or 56*b*. Ink tanks 43*a* to 43*d* are removable from cartridge 28 and store ink used by printer 10 to print images. Specifically, ink tanks 43*a* to 43*d* are inserted within cartridge 28 and can be removed by actuating retention tabs 53*a* to 53*d*, respectively. Ink tanks 43*a* to 43*d* can store color (e.g., cyan, magenta and yellow) ink and/or black ink. The structure of ink tanks 43*a* to 43*b* may be similar to that described in U.S. Pat. No. 5,509,140, or may be any other type of ink tank that can be installed in cartridge 28 to supply ink to print heads 56*a* and 56*b*.

Figure 8:
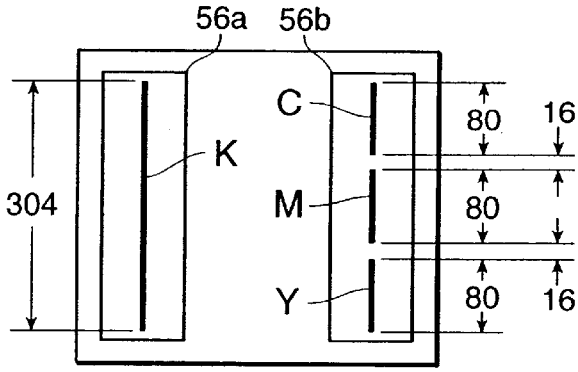
FIG. 8 is a plan view of a print head and nozzle configuration of the print cartridge of FIG. 7.

FIG. 8 depicts a nozzle configuration for each of print heads 56*a* and 56*b*. In FIG. 8, print head 56*a* is for printing black ink and print head 56*b* is for printing color ink. Print head 56*a* preferably includes 304 nozzles at a 600 dpi pitch spacing. Print head 56*b* preferably includes 80 nozzles at a 600 dpi pitch for printing cyan ink, 80 nozzles at a 600 dpi pitch for printing magenta ink, and 80 nozzles at a 600 dpi pitch for printing yellow ink. An empty space is provided between each set of nozzles in print head 56*b* corresponding to 16 nozzles spaced at a 600 dpi pitch. Each of print heads 56*a* and 56*b* eject ink based on commands received from a controller on circuit board 35.

Figure 9:
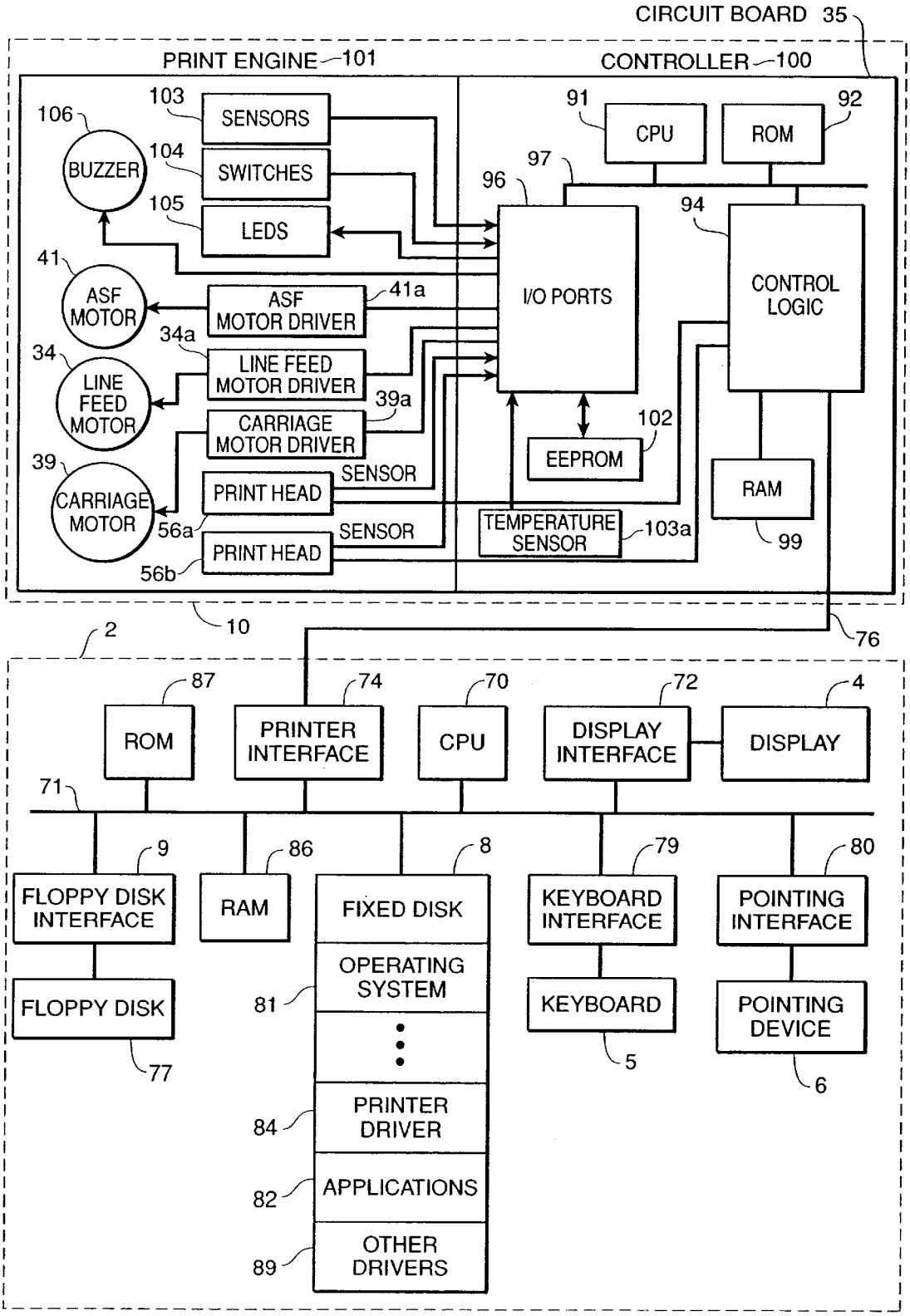
FIG. 9 is a block diagram showing the hardware configuration of a host processor interfaced to the printer of the present invention.

FIG. 9 is a block diagram showing the internal structures of host processor 2 and printer 10. In FIG. 9, host processor 2 includes a central processing unit 70 such as a programmable microprocessor interfaced to computer bus 71. Also coupled to computer bus 71 are display interface 72 for interfacing to display 4, printer interface 74 for interfacing to printer 10 through bi-directional communication line 76, floppy disk interface 9 for interfacing to floppy disk 77, keyboard interface 79 for interfacing to keyboard 5, and pointing device interface 80 for interfacing to pointing device 6. Disk 8 includes an operating system section for storing operating system 81, an applications section for storing applications 82, and a printer driver section for storing printer driver 84.

A random access main memory (hereinafter "RAM") 86 interfaces to computer bus 71 to provide CPU 70 with access to memory storage. In particular, when executing stored application program instruction sequences such as those associated with application programs stored in applications section 82 of disk 8, CPU 70 loads those application instruction sequences from disk 8 (or other storage media such as media accessed via a network or floppy disk interface 9) into random access memory (hereinafter "RAM") 86 and executes those stored program instruction sequences out of RAM 86. RAM 86 provides for a print data buffer used by printer driver 84. It should also be recognized that standard disk-swapping techniques available under the windowing operating system allow segments of memory, including the aforementioned print data buffer, to be swapped on and off of disk 8. Read only memory (hereinafter "ROM") 87 in host processor 2 stores invariant instruction sequences, such as start-up instruction sequences or basic input/output operating system (BIOS) sequences for operation of keyboard 5.

As shown in FIG. 9, and as previously mentioned, disk 8 stores program instruction sequences for a windowing operating system and for various application programs such as graphics application programs, drawing application programs, desktop publishing application programs, and the like. In addition, disk 8 also stores color image files such as might be displayed by display 4 or printed by printer 10 under control of a designated application program. Disk 8 also stores a color monitor driver in other drivers section 89 which controls how multi-level RGB color primary values are provided to display interface 72. Printer driver 84 controls printer 10 for both black and color printing and supplies print data for print out according to the configuration of printer 10. Print data is transferred to printer 10, and control signals are exchanged between host processor 2 and printer 10, through printer interface 74 connected to line 76 under control of printer driver 84. Printer interface 74 and line 76 may be, for example an IEEE 1284 parallel port and cable or a universal serial bus port and cable. Other device drivers are also stored on disk 8, for providing appropriate signals to various devices, such as network devices, facsimile devices, and the like, connected to host processor 2.

Ordinarily, application programs and drivers stored on disk 8 first need to be installed by the user onto disk 8 from other computer-readable media on which those programs and drivers are initially stored. For example, it is customary for a user to purchase a floppy disk, or other computer-readable media such as CD-ROM, on which a copy of a printer driver is stored. The user would then install the printer driver onto disk 8 through well-known techniques by which the printer driver is copied onto disk 8. At the same time, it is also possible for the user, via a modem interface (not shown) or via a network (not shown), to download a printer driver, such as by downloading from a file server or from a computerized bulletin board.

Referring again to FIG. 9, printer 10 includes a circuit board 35 which essentially contain two sections, controller 100 and print engine 101. Controller 100 includes CPU 91 such as an 8-bit or a 16-bit microprocessor including programmable timer and interrupt controller, ROM 92, control logic 94, and I/O ports unit 96 connected to bus 97. Also connected to control logic 94 is RAM 99. Control logic 94 includes controllers for line feed motor 34, for print image buffer storage in RAM 99, for heat pulse generation, and for head data. Control logic 94 also provides control signals for nozzles in print heads 56*a* and 56*b* of print engine 101, carriage motor 39, ASF motor 41, line feed motor 34, and print data for print heads 56*a* and 56*b*. EEPROM 102 is connected to I/O ports unit 96 to provide non-volatile memory for printer information and also stores parameters that identify the printer, the driver, the print heads, the status of ink in the cartridges, etc., which are sent to printer driver 84 of host processor 2 to inform host processor 2 of the operational parameters of printer 10.

I/O ports unit 96 is coupled to print engine 101 in which a pair of print heads 56*a* and 56*b* perform recording on a recording medium by scanning across the recording medium while printing using print data from a print buffer in RAM 99. Control logic 94 is also coupled to printer interface 74 of host processor 2 via communication line 76 for exchange of control signals and to receive print data and print data addresses. ROM 92 stores font data, program instruction sequences used to control printer 10, and other invariant data for printer operation. RAM 99 stores print data in a print buffer defined by printer driver 84 for print heads 56*a* and 56*b* and other information for printer operation.

Sensors, generally indicated as 103, are arranged in print engine 101 to detect printer status and to measure temperature and other quantities that affect printing. A photo sensor (e.g., an automatic alignment sensor) measures print density and dot locations for automatic alignment. Sensors 103 are also arranged in print engine 101 to detect other conditions such as the open or closed status of access door 12, presence of recording media, etc. In addition, diode sensors, including a thermistor, are located in print heads 56*a* and 56*b* to measure print head temperature, which is transmitted to I/O ports unit 96.

I/O ports unit 96 also receives input from switches 104 such as power button 26 and resume button 24 and delivers control signals to LEDs 105 to light indicator light 23, to line feed motor 34 ASF motor 41 and carriage motor 39 through line feed motor driver 34*a*, ASF motor driver 41*a* and carriage motor driver 39*a*, respectively.

Although FIG. 9 shows individual components of printer 10 as separate and distinct from one another, it is preferable that some of the components be combined. For example, control logic 94 may be combined with I/O ports 96 in an ASIC to simplify interconnections for the functions of printer 10.

Figure 10:
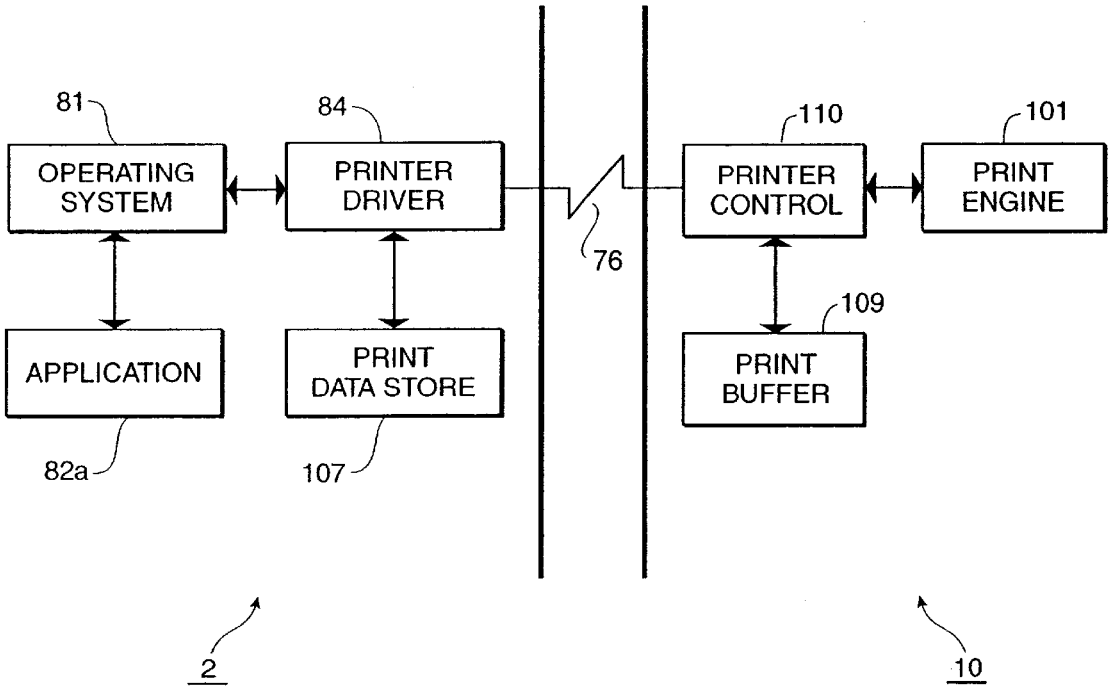
FIG. 10 shows a functional block diagram of the host processor and printer shown in FIG. 8.

FIG. 10 shows a high-level functional block diagram that illustrates the interaction between host processor 2 and printer 10. As illustrated in FIG. 10, when a print instruction is issued from image processing application program 82*a* stored in application section 82 of disk 8, operating system 81 issues graphics device interface calls to printer driver 84. Printer driver 84 responds by generating print data corresponding to the print instruction and stores the print data in print data store 107. Print data store 107 may reside in RAM 86 or in disk 8, or through disk swapping operations of operating system 81 may initially be stored in RAM 86 and swapped in and out of disk 8. Thereafter, printer driver 84 obtains print data from print data store 107 and transmits the print data through printer interface 74, to bi-directional communication line 76, and to print buffer 109 through printer control 110. Print buffer 109 resides in RAM 99, and printer control 110 resides in firmware implemented through control logic 94 and CPU 91 of FIG. 9. Printer control 110 processes the print data in print buffer 109 responsive to commands received from host processor 2 and performs printing tasks under control of instructions stored in ROM 92 (see FIG. 9) to provide appropriate print head and other control signals to print engine 101 for recording images onto recording media.

Print buffer 109 has a first section for storing print data to be printed by one of print heads 56*a* and 56*b*, and a second section for storing print data to be printed by the other one of print heads 56*a* and 56*b*. Each print buffer section has storage locations corresponding to the number of print positions of the associated print head. These storage locations are defined by printer driver 84 according to a resolution selected for printing. Each print buffer section also includes additional storage locations for transfer of print data during ramp-up of print heads 56*a* and 56*b* to printing speed. Print data is transferred from print data store 107 in host processor 2 to storage locations of print buffer 109 that are addressed by printer driver 84. As a result, print data for a next scan may be inserted into vacant storage locations in print buffer 109 both during ramp up and during printing of a current scan.

Figure 11:
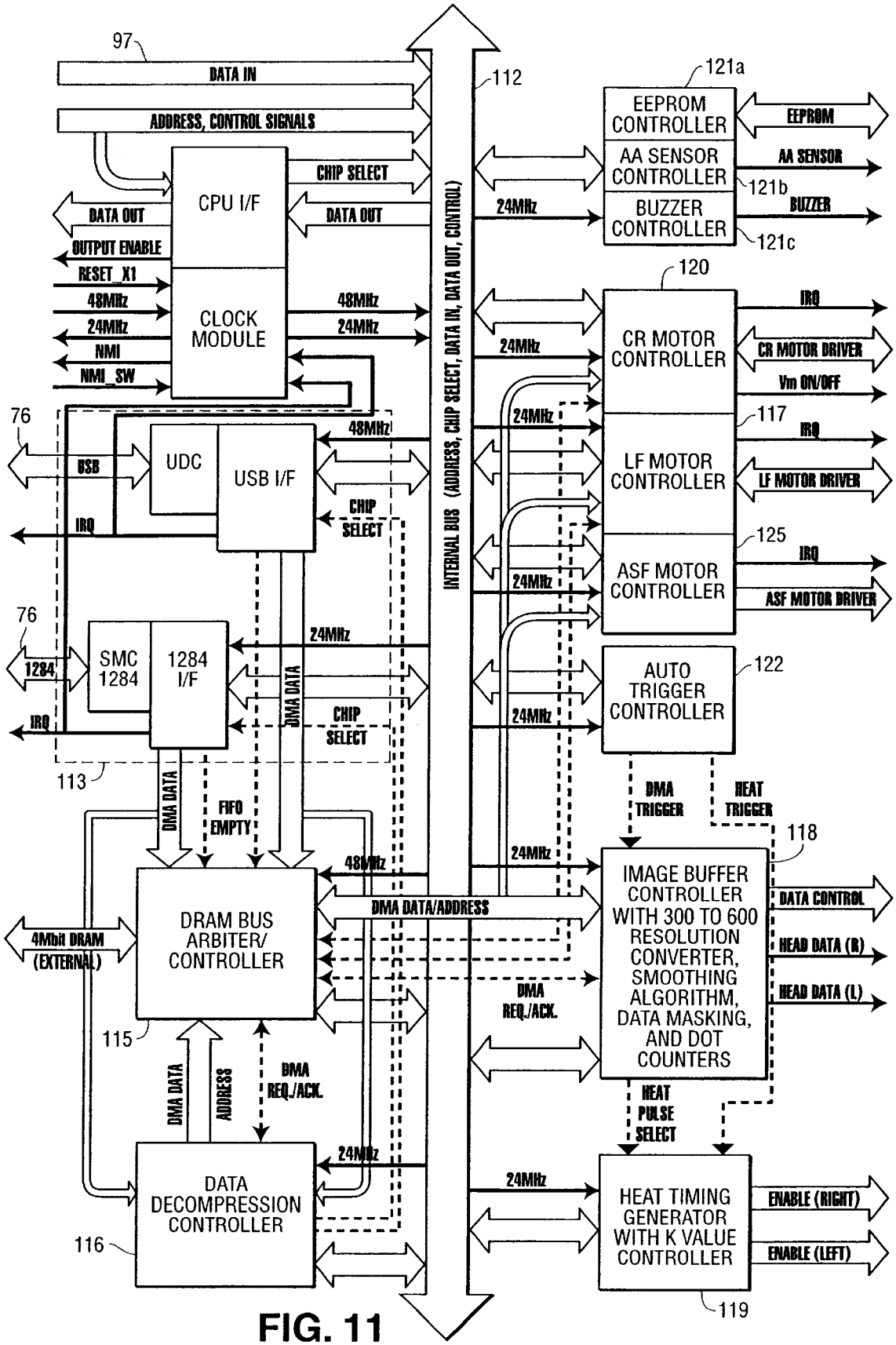
FIG. 11 is a block diagram showing the internal configuration of the gate array shown in FIG. 9.

FIG. 11 depicts a block diagram of a combined configuration for control logic 94 and I/O ports unit 96, which as mentioned above, I/O ports unit 96 may be included within control logic 94. In FIG. 11, internal bus 112 is connected to printer bus 97 for communication with printer CPU 91. Bus 112 is coupled to host computer interface 113 (shown in dashed lines) which is connected to bi-directional line 76 for carrying out bi-directional communication. As shown in FIG. 11, bi-directional line 76 may be either an IEEE-1284 line or a USB line. Bi-directional communication line 76 is also coupled to printer interface 74 of host processor 2. Host computer interface 113 includes both IEEE-1284 and USB interfaces, both of which are connected to bus 112 and to DRAM bus arbiter/controller 115 for controlling RAM 99 which includes print buffer 109 (see FIGS. 9 and 10). Data decompressor 116 is connected to bus 112, DRAM bus arbiter/controller 115 and each of the IEEE-1284 and USB interfaces of host computer interface 113 to decompress print data when processing. Also coupled to bus 112 are line feed motor controller 117 that is connected to line feed motor driver 34*a* of FIG. 9, image buffer controller 118 which provides serial control signals and head data signals for each of print heads 56*a* and 56*b*, heat timing generator 119 which provides block control signals and analog heat pulses for each of print heads 56*a* and 56*b*, carriage motor controller 120 that is connected to carriage motor driver 39*a* of FIG. 9, and ASF motor controller 125 that is connected to ASF motor driver 41*a* of FIG. 9. Additionally, EEPROM controller 121*a*, automatic alignment sensor controller 121*b* and buzzer controller 121 are connected to bus 112 for controlling EEPROM 102, an automatic alignment sensor (generally represented within sensors 103 of FIG. 9), and buzzer 106. Further, auto trigger controller 122 is connected to bus 112 and provides signals to image buffer controller 118 and heat timing generator 119, for controlling the firing of the nozzles of print heads 56*a* and 56*b*.

Control logic 94 operates to receive commands from host processor 2 for use in CPU 91, and to send printer status and other response signals to host processor 2 through host computer interface 113 and bi-directional communication line 76. Print data and print buffer memory addresses for print data received from host processor 2 are sent to print buffer 109 in RAM 99 via DRAM bus arbiter/controller 115, and the addressed print data from print buffer 109 is transferred through controller 115 to print engine 101 for printing by print heads 56*a* and 56*b*. In this regard, heat timing generator 119 generates analog heat pulses required for printing the print data.

Figure 12:
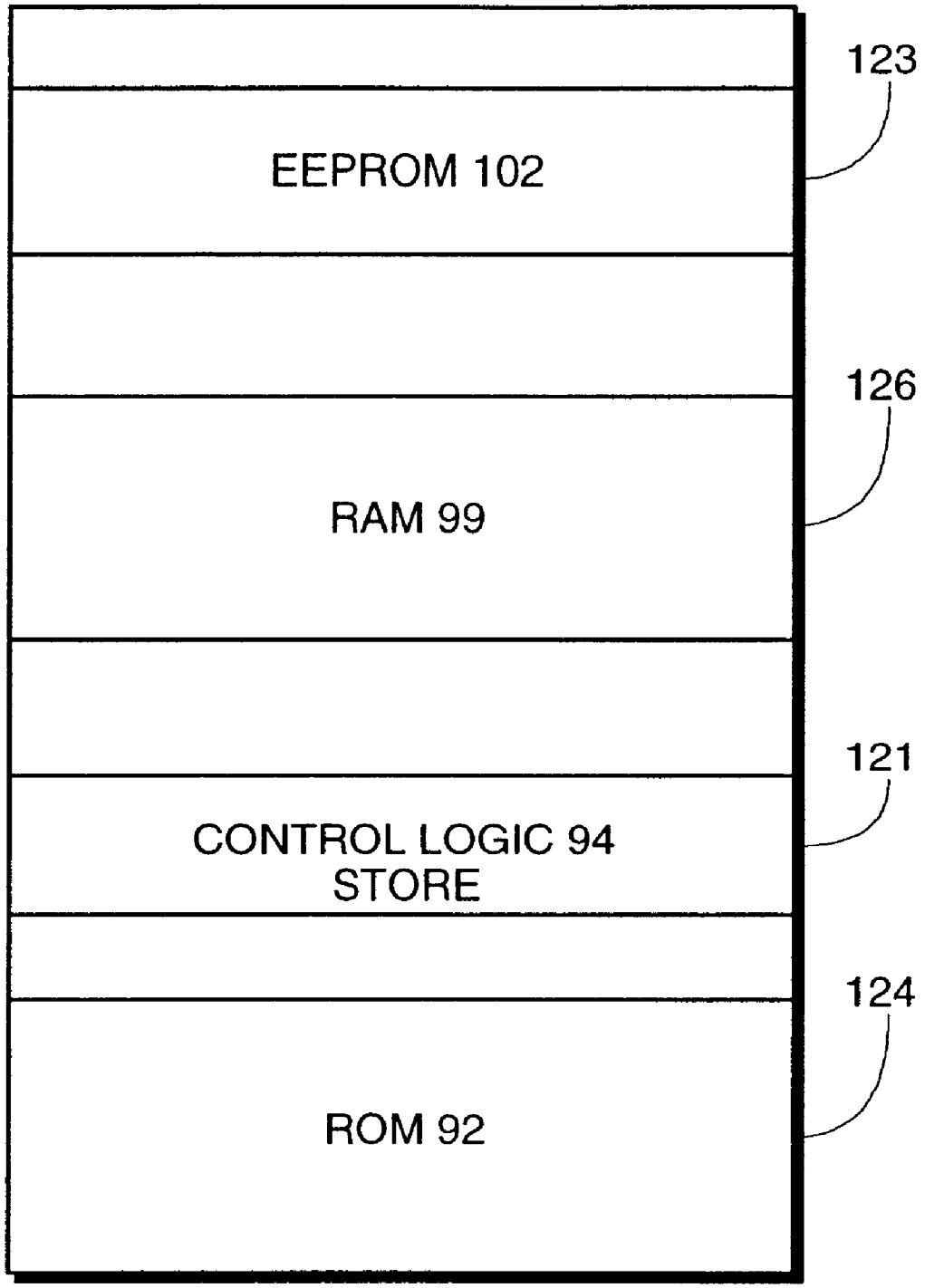
FIG. 12 shows the memory architecture of the printer of the present invention.

FIG. 12 shows the memory architecture for printer 10. As shown in FIG. 11, EEPROM 102, RAM 99, ROM 92 and temporary storage 121 for control logic 94 form a memory structure with a single addressing arrangement. Referring to FIG. 11, EEPROM 102, shown as non-volatile memory section 123, stores a set of parameters that are used by host processor 2 and that identify printer and print heads, print head status, print head alignment, and other print head characteristics. EEPROM 102 also stores another set of parameters, such as clean time, auto-alignment sensor data, etc., which are used by printer 10. ROM 92, shown as memory section 124, stores information for printer operation that is invariant, such as program sequences for printer tasks and print head operation temperature tables that are used to control the generation of nozzle heat pulses, etc. A random access memory section 121 stores temporary operational information for control logic 94, and memory section 126 corresponding to RAM 99 includes storage for variable operational data for printer tasks and print buffer 109.

A more detailed description will now be made of compensation for paper unevenness with reference to FIGS. 14 to 25. Briefly, compensation for paper unevenness involves inducing an unevenness (cockling) pattern into the recording medium with known parameters, and utilizing the known parameters, calculating a firing frequency and an auto trigger delay in auto trigger controller 122 of FIG. 11 for controlling the firing frequency and timing of print heads 56*a* and 56*b*. Inducing a known cockling pattern will be discussed first and then calculating the firing frequency and auto trigger delay will be discussed.

Figure 14:
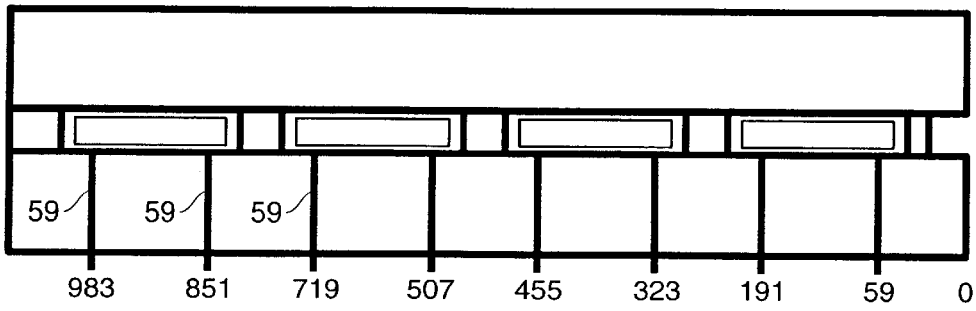
FIG. 14 depicts a plan view of a cockling rib spacing according to the invention.

As pointed out above with regard to FIG. 5, printer 10 includes cockling ribs 59. Cockling ribs 59 are utilized to induce an unevenness pattern into the recording medium. FIG. 14 depicts a plan (top) view of one possible spacing of cockling ribs 59. As seen in FIG. 14, cockling ribs 59 may be spaced with a first rib located 59 pulses from a home position (zero) and the remaining ribs being located at 132 pulse increments from one another (59, 191, 323, 455, 587, 719, 851 and 983 pulses, respectively). Pulses refer to pulses of carriage control motor 39. That is, carriage 45 is driven by carriage motor 39 via a drive gear attached to the motor and belt 25. The drive gear has been sized such that each pulse of carriage motor 39 results in a horizontal translation of carriage 45 of five 600 dpi pixels. Therefore, it takes 59 pulses of carriage motor 39 to translate carriage 45 from the home position (zero) to the first rib located 59 pulses away from the home position. Of course, a 132 pulse spacing between cockling ribs 59 is not the only spacing that could be used to practice the invention and any other spacing could be used to achieve the same results as the present invention. However, the inventors herein have discovered that the 132 pulse spacing described above, combined with other features that will be described below, provide for good printing results with reduced image roughness.

Figure 15:
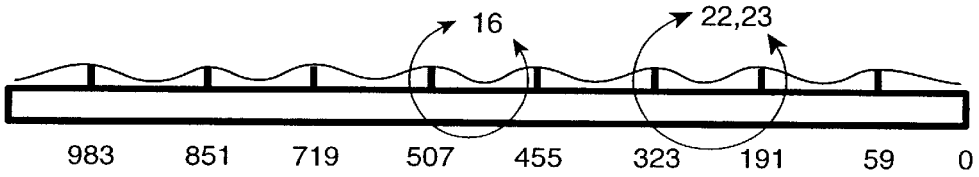
FIG. 15 depicts a front view of a cockling rib spacing according to the invention.

As the recording medium is fed through the printer, it rests on cockling ribs 59. Cockling ribs 59 induce a slight sinusoidal waveform pattern into the recording medium as seen in FIG. 15. Since the spacing of cockling ribs 59 is known (here, 132 pulses as seen in FIG. 14), the period of the sinusoidal waveform pattern (cockling pattern) is also known and corresponds to the spacing of cockling ribs 59. Therefore, the period of the sinusoidal pattern is also 132 pulses. Of course, as stated above, a sinusoidal period of 132 pulses is not required to practice the invention and adjustments to the period size could be made to provide for a different period. As such, the 132 period is merely one example of a period size that may be used to practice the invention.

Figure 16:
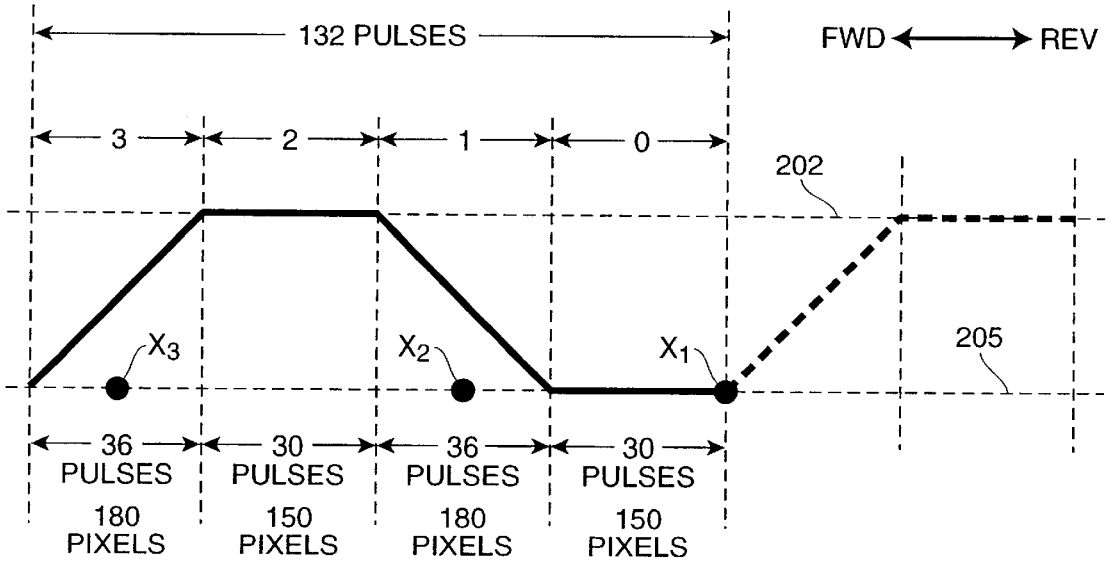
FIG. 16 is an enlarged view of a portion of FIG. 15.

FIG. 16 is an enlarged view of a portion of the waveform pattern shown in FIG. 15 and depicts one period of the sinusoidal waveform. It should be noted that the enlarged portion shown in FIG. 16 and the following discussion regarding FIGS. 16 and 18 generally applies to a case where the recording medium is plain paper. That is, the waveform shape shown in FIG. 16 depicts a typical waveform that results from printing on plain paper. A case where printing is performed on high grade paper will be discussed below with regard to FIG. 23. FIGS. 15 and 16 are utilized in determining parameters associated with the waveform pattern that, as will be described below, are set in a routine that calculates the auto trigger delay. In FIG. 16, the waveform shape has been simplified to depict straight segments connected by abrupt intersecting points. The straight segments and abrupt intersections are mere estimates of the waveform shape of the recording medium and provide for simplified calculations, as will be described below. Of course, in reality the recording medium takes on a more curved shape rather than the abrupt intersections. As such, if more accurate calculations are desired in order to provide for an even higher quality image, then additional straight segments may be added, or the straight segments may be replaced with curved segments. For simplicity, however, the description of the preferred embodiment herein utilizes the simplified waveform configuration shown in FIG. 16.

As seen in FIG. 16, in performing the calculations that will be described below, one period of the waveform shape is divided into four blocks (0, 1, 2 and 3, respectively). Blocks 0 and 2 correspond to low and high spots in the waveform shape, respectively. As with the cockling rib spacing, the number of blocks that the period is divided into can be varied to provide for additional accuracy, if desired. However, the inventors herein have opted to divide each period into four blocks. Blocks 1 and 3 correspond to ramp-up and ramp-down portions of the waveform shape, respectively, for a forward scan, and ramp-down and ramp-up portions, respectively, for a reverse scan.

As can readily be seen in FIG. 16, it takes 132 pulses of carriage motor 39 to cause carriage 45 to traverse one period of the waveform shape. Similarly, it takes carriage motor 39 a portion of the 132 pulses to cause carriage 45 to traverse each of blocks 0 to 3, respectively. It has been found that when recording on plain paper, each of the ramp-up and ramp-down portions of the waveform shape are slightly larger than the top and bottom portions. Therefore, blocks 0 and 2 are each assigned 30 pulses of the 132 pulse period, and blocks 1 and 3 are each assigned 36 pulses of the 132 pulse period. Again, any other number of pulses could be set for each block according to a preferred design but the inventors herein have opted for the forgoing pulse assignment for each block.

As stated above, each pulse of carriage motor 39 has been set to provide for a five 600 dpi pixel translation. That is, for each pulse of carriage motor 39, five 600 dpi pixels are to be printed. Accordingly, since blocks 0 and 2 have been assigned 30 pulses, 150 (30 pulses×5 pixels) 600 dpi pixels are printed in blocks 0 and 2. Similarly, since blocks 1 and 3 have each been assigned 36 pulses, 180 600 dpi pixels are printed in blocks 1 and 3.

The foregoing discussion of the cockling rib design (i.e spacing of cockling ribs 59), the period of the waveform shape of the recording medium and the number of pixels for each block is meant to arrive at parameters that are set for calculating the firing frequency and the auto trigger delay. In the foregoing discussion, each period of the waveform shape was broken down into four blocks (blocks 0, 1, 2 and 3), and each block was designated as receiving 150, 180, 150 and 180, pixels respectively. As will be discussed below, the number of pixels in each block will be referred to as an auto trigger count (ATTRGCNT) and are set in a routine that calculates the firing frequency and the auto trigger delay.

Before discussing the auto trigger delay and firing frequency calculation routine, the parameters and formulas utilized in the calculations will be discussed with regard to FIG. 17 and FIG. 18.

Figure 17:
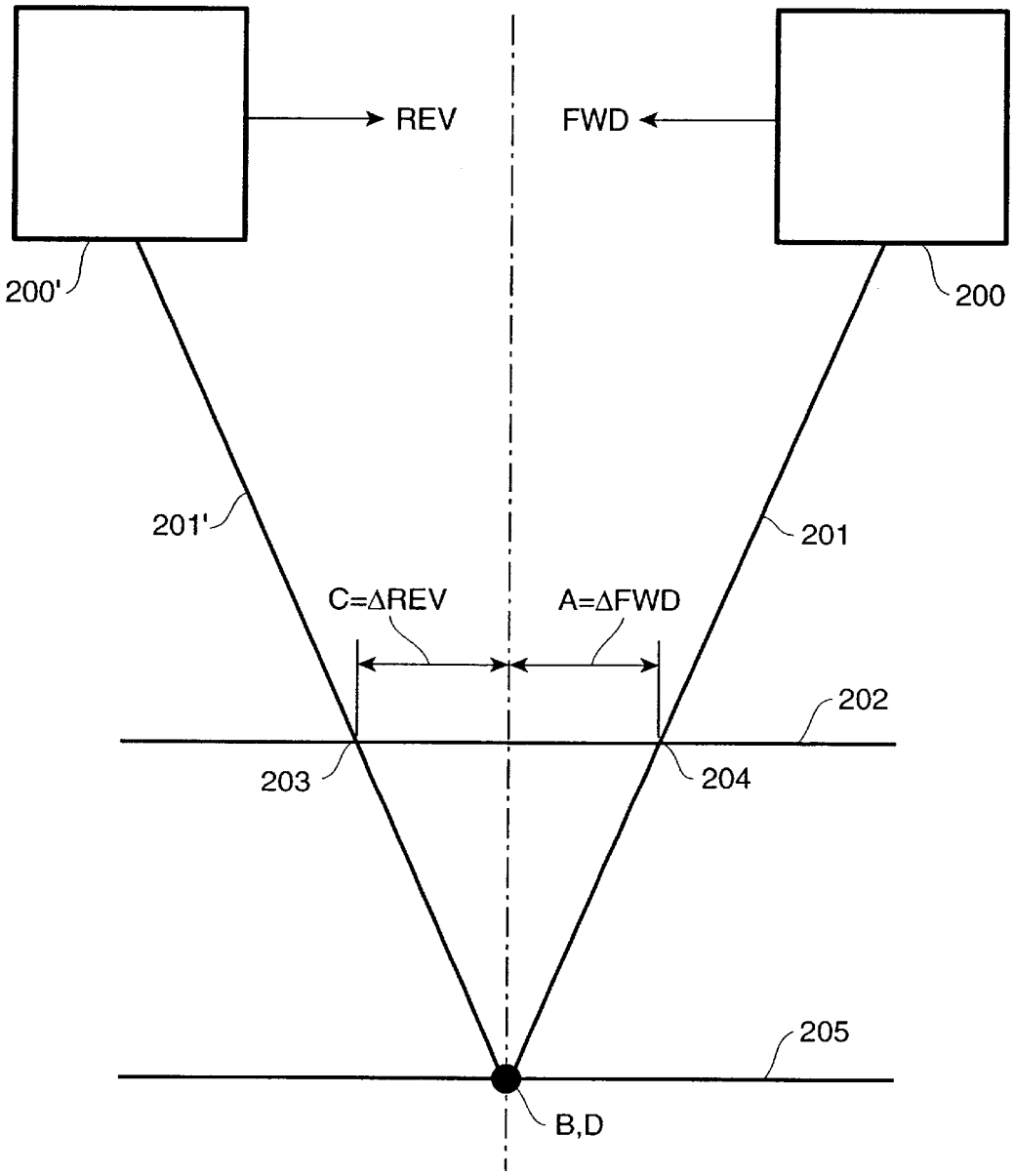
FIG. 17 is a diagram depicting variables utilized in the calculations of FIG. 18.

FIG. 17 depicts a diagram of parameters utilized in the formulas of FIG. 18 for calculating the firing frequency and an auto trigger delay. In FIG. 17, reference number 200 represents a print head scanning in a forward direction and 200' represents the same print head scanning in a reverse direction. Reference numbers 202 and 205 represent the top and bottom surfaces, respectively, of the waveform shape of the paper, such as those portions shown in blocks 2 and 0, respectively, of FIG. 16. Print head 200 ejects an ink droplet along a trajectory 201 and print head 200' ejects an ink droplet along a trajectory 201'. Surface 205 is a reference surface for performing the calculations. That is, if the paper were perfectly flat rather than having a waveform shape, the entire paper surface would be located along the bottom surface 205. As such, if print heads 200 and 200' were to eject ink droplets along trajectories 201 and 201' respectively, the ink droplets would contact the paper at points B and D, respectively. However, the paper is not flat but has a waveform shape. Therefore, if print head 200 were to eject an ink droplet with the target contact point being point B, and the top of the waveform shape is within the trajectory path 201, the ink droplet will not contact the paper at point B, but will contact the paper at point 204.

As can be seen in FIG. 17, point 204 is offset a horizontal distance relative to point B by an amount A. This offset in the ink droplet contact point causes image roughness. Therefore, to reduce the image roughness, the timing of the nozzle firing by the print head is adjusted so that the ink droplet contacts the paper with a relatively even spacing. As can be seen in FIG. 17 and FIG. 18, the amount of offset for the forward scan of print head 200 is a value A (represented in FIG. 18 as ΔFWD). A similar calculation is performed for the reverse scan in order to adjust the nozzle firing of print head 200' an amount C (represented in FIG. 18 as ΔREV).

FIG. 18 is a table that summarizes the calculations for adjusting the firing frequency and the auto trigger delay for each of the blocks shown in FIG. 16. As can be seen in FIG. 18, since block 0 is the bottom surface (the reference surface), no adjustment in the timing of the firing (auto trigger delay (ATTRGDelay)) is required for either the forward or reverse scans. Additionally, no adjustment is required for the firing frequency (Interval (GA_ATTRGPER)) in block 0 since this is the target surface as described above. In FIG. 18, the Interval (GA_ATTRGPER) for block 0 is given as 1334, which refers to the gate array state. The value 1334 is derived from a gate array of 41.6667 ηsec/unit and a nozzle firing frequency of 55,000 ηsec (55 μsec or 18 KHz), where 55,000 ηsec÷41.6667 ηsec=1334. Therefore, for simplicity, the Interval (GA_ATTRGPER) is referred to as a 1334 state. Similarly, a 9 KHz firing frequency would correspond to a 2668 state.

Referring again to FIG. 18, for the top surface (block 2), the timing (auto trigger timing (ATTRGDelay)) is adjusted for the offset amounts A and C, respectively. That is, assuming that the bottom surface (block 0) is the target surface, the timing for firing the nozzles in block 2 is adjusted for the offsets (ΔFWD and ΔREV) as described above. With regard to adjustment of the firing frequency, it is assumed that the top surface is flat as shown in block 2 of FIG. 16, and therefore no adjustment is required for the Interval (GA_ATTRGPER) and the ink droplets are ejected at the same frequency as the bottom surface, i.e. 1334 state.

Figure 13A:
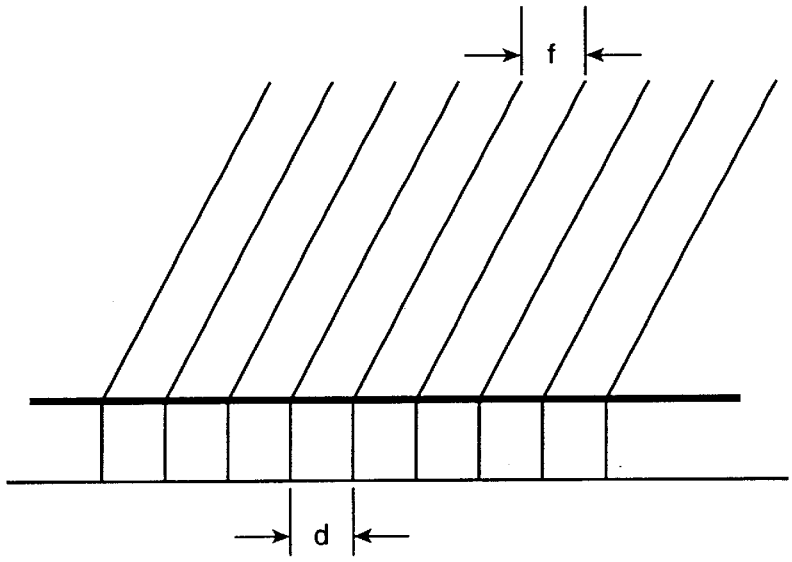
FIGS. 13A and 13B depict an ink droplet spacing in the prior art.
Figure 13B:
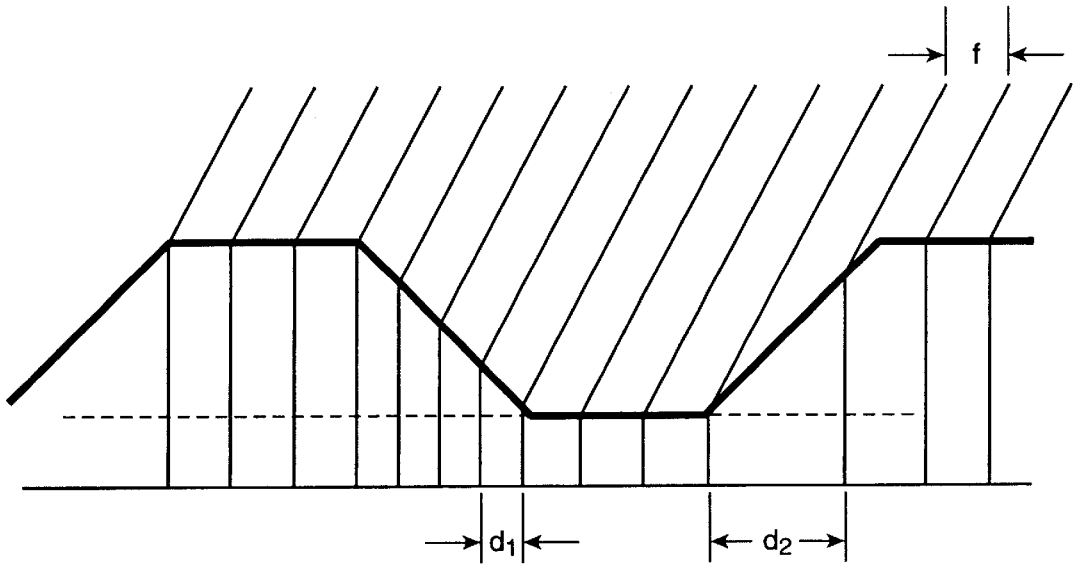

For the ramp-up and ramp-down regions (blocks 1 and 3), more involved calculations are performed. In blocks 1 and 31 some adjustment to the firing frequency is required in order to obtain the same contact spacing as blocks 0 and 2. That is, as described above with regard to FIG. 13, in the ramp-up regions, if the ink droplets are ejected at the same frequency as the top and bottom regions, a narrower contact pattern (d1) would result. Similarly, a wider contact pattern (d2) would result in ramp-down regions. Therefore, the firing frequency is adjusted in these regions to compensate for the narrower and wider contact patterns.

In FIG. 18, the Interval (GA_ATTRGPER) is adjusted for blocks 1 and 3 for a forward scan as follows:

GA_ATTRGPER=(1334+α), for block 1 (ramp-up), and

GA_ATTRGPER=(1334−α), for Block 3 (ramp-down), where, $$\alpha = \frac{1334}{180}(A - B).$$

For a reverse scan, the Interval (GA_ATTRGPER) is adjusted for blocks 1 and 3 as follows:

GA_ATTRGPER=(1334−β), for block 1 (ramp-down), and

GA_ATTRGPER=(1334+β), for block 3 (ramp-up), where, $$\beta = \frac{1334}{180}(C - D).$$

The variables A, B, C and D all refer to the variables shown in FIG. 17. Utilizing the above formulas, the firing frequency in blocks 1 and 3 is adjusted to compensate for the paper unevenness.

Having calculated the firing frequency (Interval (GA_ATTRGPER)) for blocks 1 and 3, an auto trigger delay (ATTRGDelay) for blocks 1 and 3 is also calculated. As seen in FIG. 18, the ATTRGDelay for each block is calculated as follows:

$(X_2-X_1-150)\times(A+B)\div180$, for block 1, forward scan, $(X_2-X_1-150)\times(C-D)\div180$, for block 1, reverse scan, $(X_1+720-X_3)\times(A-B)\div180$, for block 3, forward scan, and $(X_1+720-X_3)\times(C-D)\div180$, for block 3, reverse scan.

In each of the foregoing formulas for calculating the auto trigger delay (ATTRGDelay) of blocks 1 and 3, $X_1$ refers to the beginning point of block 0 as shown in FIG. 16. Additionally, $X_2$ and $X_3$ refer to a point within blocks 1 and 3, respectively, where the print data begins (and consequently, an adjustment in the gate array starting position), as shown in FIG. 16.

Figure 19:
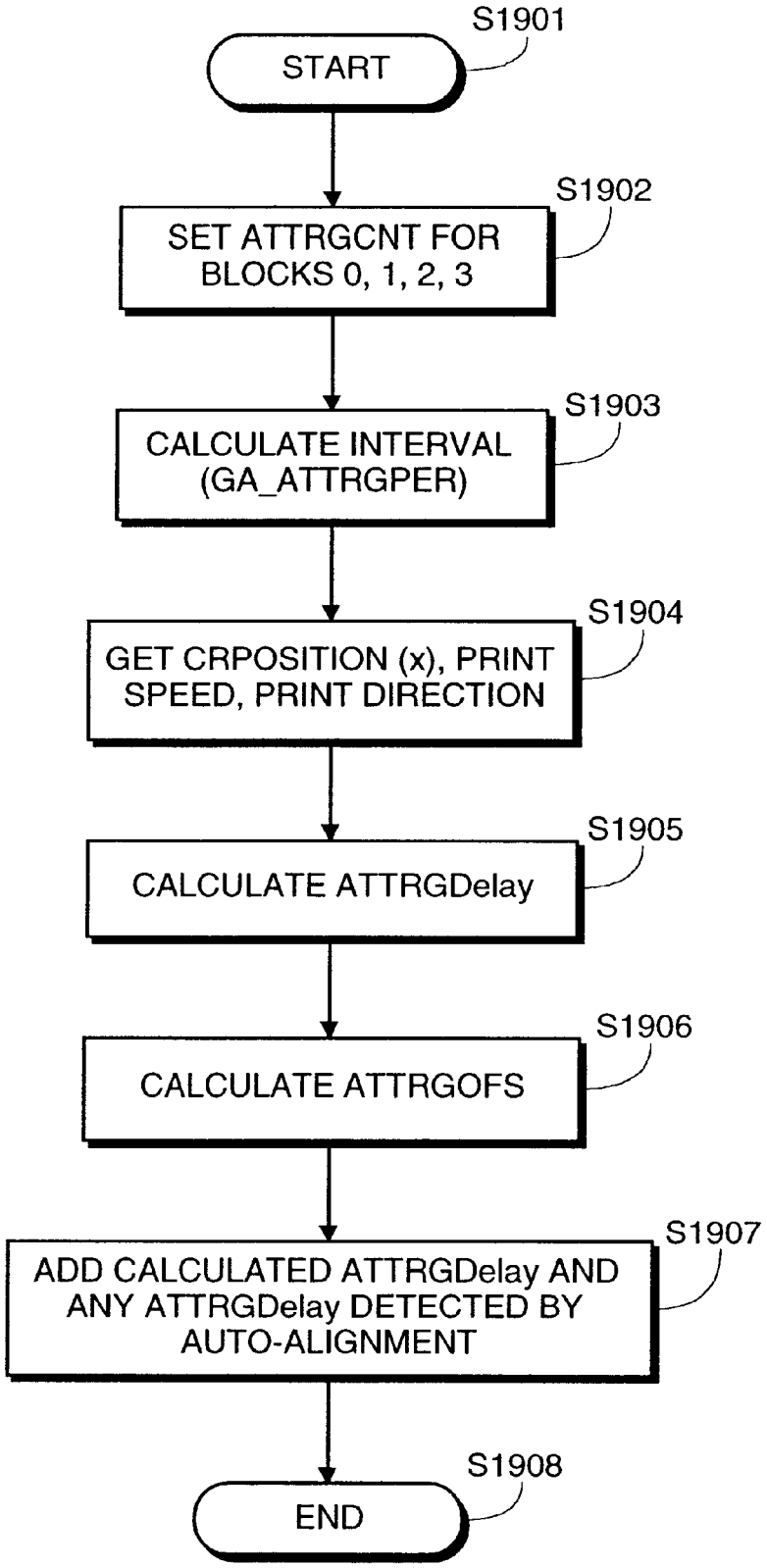
FIG. 19 is a flowchart of process steps for adjusting a firing frequency for paper cockling according to the invention.

FIG. 19 is a flowchart of process steps for a routine that calculates the firing frequency and auto trigger delay for each of blocks 0 to 3 utilizing the formulas of FIG. 18 described above. As seen in FIG. 19, in step S1901 the routine begins. In step S1902, an ATTRGCNT (auto trigger count) value is set for each of blocks 0, 1, 2 and 3. The ATTRGCNT value for each block corresponds to the number of pixels assigned to each block as described above with regard to FIG. 16. In FIG. 16, blocks 0 and 2 were each assigned 150 600 dpi pixels and blocks 1 and 3 were each assigned 180 600 dpi pixels. Therefore, the ATTRGCNT values set for each of blocks 0 to 3 correspond to 150, 180, 150 and 180, respectively. As previously stated, these values are based on a selected design for the spacing of cockling ribs 59, a number of blocks assigned for the spacing, and the number of pixels printed per pulse. Therefore, it is not necessary that the ATTRGCNT values be set to 150, 180, 150 and 180 and these values can vary based on a selected design and the invention can be implemented accordingly to achieve a desired result.

In step S1903 the frequency (Interval, GA_ATTRGPER) is calculated for each block. Then, in step S1904, the position of carriage 45 along a scan direction (x)(CRPosition (x)), the print speed (i.e. 1334 state or 2668 state), and the print direction (forward or reverse) are obtained. Next, in step S1905 an auto trigger delay (ATTRGDelay) is calculated and in step S1906 an auto trigger offset (ATTRGOFS) is calculated. Finally, if an auto alignment process has been performed, and an auto trigger delay amount has been determined for the auto alignment, then the auto alignment auto trigger delay amount is added to the auto trigger delay (ATTRGDelay) value calculated in step S1906.

Figure 20:
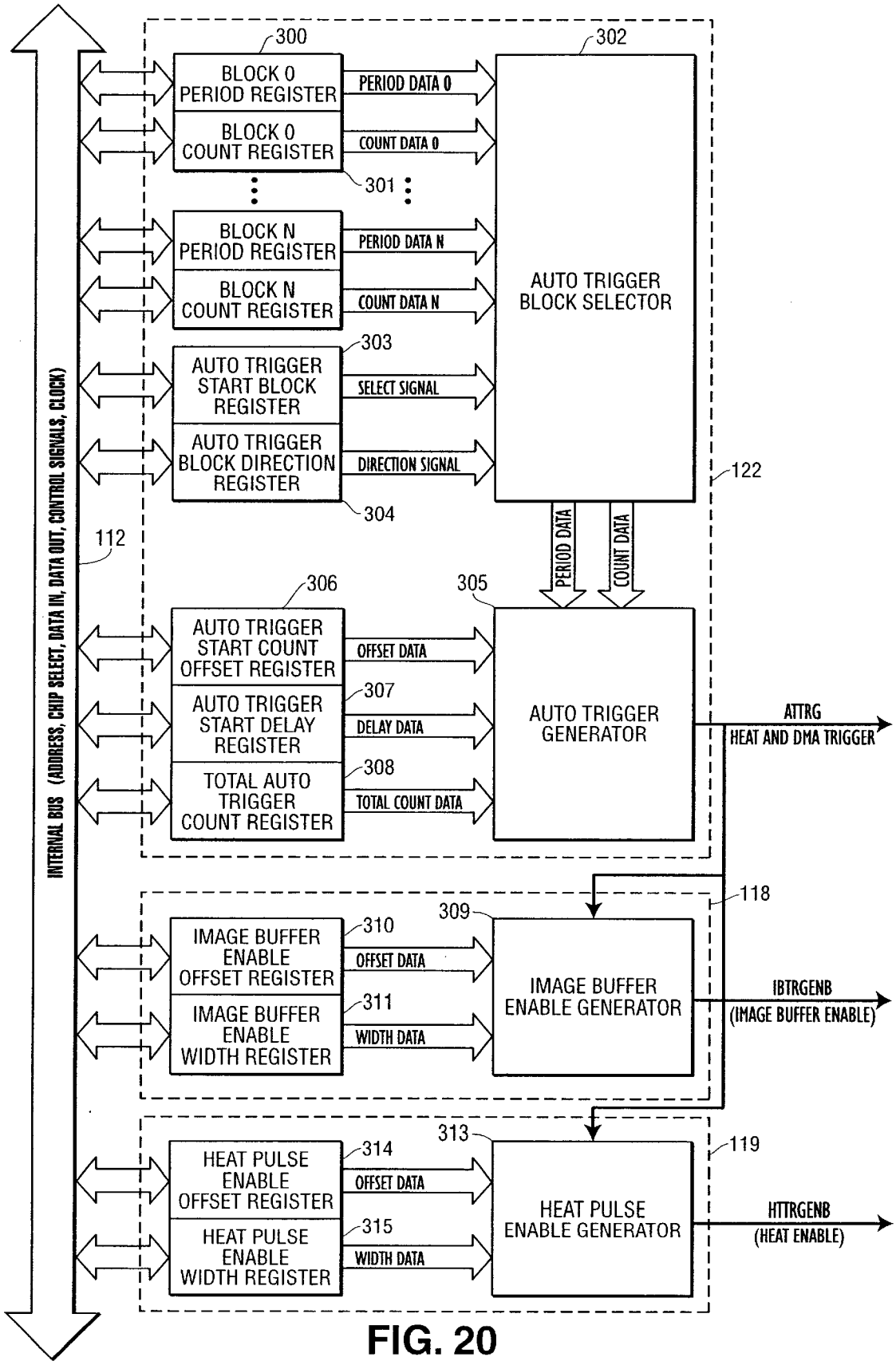
FIG. 20 is a more detailed architecture of the auto trigger controller, image buffer controller and heat timing generator of FIG. 11.

The foregoing process is carried out in auto trigger controller 122, in conjunction with image buffer controller 118 and heat timing generator 119 shown in FIG. 11. FIG. 20 depicts a more detailed architecture of auto trigger controller 122, image buffer controller 118 and heat pulse timing generator 119 of FIG. 11.

As seen in FIG. 20, auto trigger controller 122 includes period register 300 and count register 301 for block 0. Period register 300 provides period data for block 0, and count register 301 provides count data for block 0, respectively, to auto trigger block selector 302. A period register and a count register for each block, such as blocks 0, 1, 2 and 3 of FIG. 16, are provided for in auto trigger controller 122 and these have generally been provided for as block N period register and block N count register, where N represents the number of the last block. Auto trigger block selector 302 also receives select signal data from auto trigger start block register 303 and direction signal data from auto trigger block direction register 304. Each of registers 300, 301, 303 and 304 communicate with internal bus 112 to obtain their corresponding information.

Auto trigger block selector 302 communicates with auto trigger generator 305 and supplies period data and count data to generator 305. Auto trigger generator 305 also receives offset data from auto trigger start count offset register 306, delay data from auto trigger start delay register 307, and total count data from total auto trigger count register 308. Auto trigger generator 305 outputs an ATTRG (auto trigger signal), a heat trigger signal and a DMA trigger signal. As shown in FIG. 20, as well as FIG. 11, the heat trigger signal and the DMA trigger signals are provided to image buffer controller 118 and heat timing generator 119.

Image buffer controller 118 includes image buffer enable generator 309, which receives the DMA trigger signal from auto trigger generator 305, as well as offset data from image buffer enable offset register 310, and width data from image buffer enable width register 311. Image buffer enable generator outputs an IBTRGENB (image buffer trigger enable) signal.

Heat timing generator 119 includes heat pulse enable generator 313 that receives the heat trigger signal from auto trigger generator 305, as well as offset data from heat pulse enable offset register 314, and width data from heat pulse enable width register 315. Heat pulse enable generator 313 outputs a HTTRGENB (heat trigger enable) signal.

Figure 21:
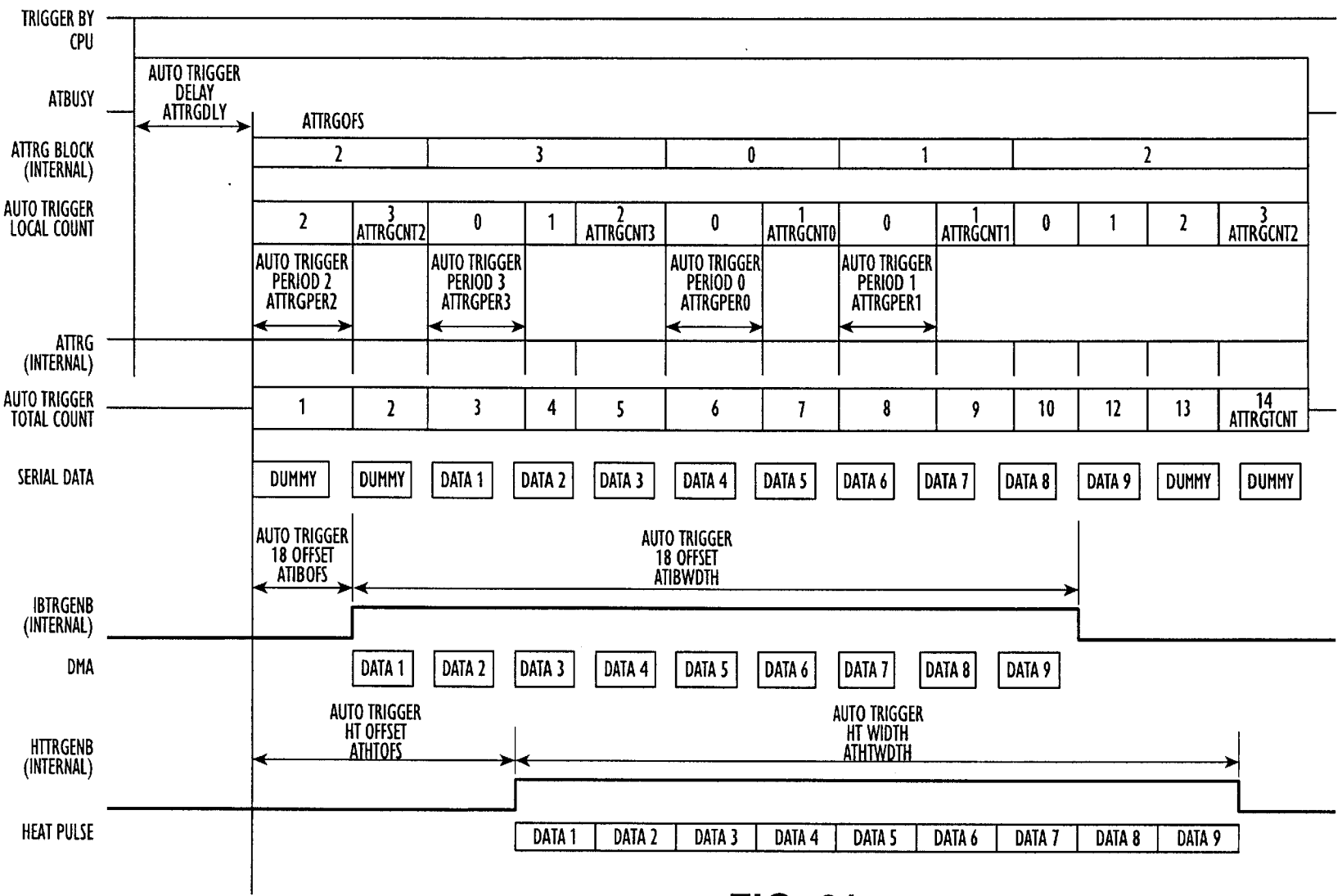
FIG. 21 depicts a timeline of the various signals in the gate array of the invention for one period.

FIG. 21 is a timeline of the various signals in the gate array for one period. The signals of FIG. 21 generally correspond to the process steps described above with regard to FIG. 19 and depict the timeline of each of the signals generated during the process steps in the gate array. It should be noted that the time line and process steps are not limited to being performed in the gate array and may be performed by software instead.

Figure 22:
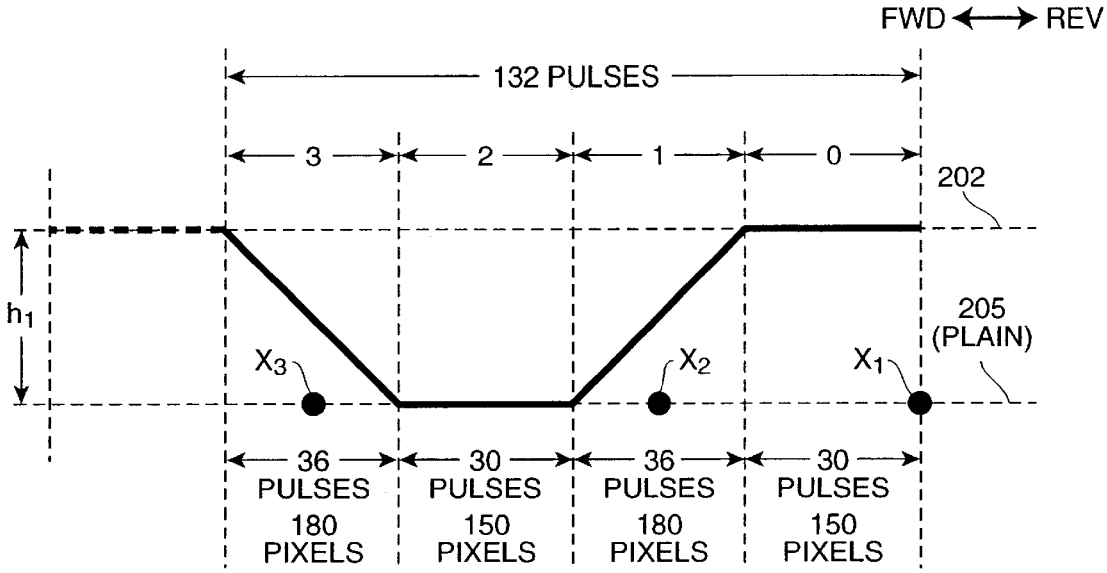
FIG. 22 is an enlarged detail view of a portion of FIG. 15 for a second embodiment of the invention utilizing plain paper.

Another embodiment of the invention will now be described with reference to FIG. 22. FIG. 22 is an enlarged detail view of a portion of FIG. 15 and is similar to FIG. 16. One difference between FIG. 22 and FIG. 16 is that each of blocks 0 to 3 have been shifted so that block 0 corresponds to the top surface 202 of the paper rather than the bottom surface 205. That is, in the present embodiment, the reference surface is the top surface 202 of the waveform shape of the paper rather than the bottom surface 205 as described above with reference to FIG. 16. Therefore, the blocks have been shifted so that block 0 corresponds to the reference surface, i.e. the top surface 202.

As stated above with regard to FIG. 16, the cockling rib design (i.e spacing of cockling ribs 59), the period of the waveform shape of the recording medium and the number of pixels for each block is meant to arrive at parameters that are set for calculating the firing frequency and the auto trigger delay. Each period of the waveform shape in the previous embodiment was broken down into four blocks (blocks 0, 1, 2 and 3), with each block receiving 150, 180, 150 and 180 pixels respectively. In the present embodiment, the waveform shape and the period are the same as the previous embodiment, but the reference surface has been changed from the bottom surface 205 to the top surface 202. As such, the blocks have merely been shifted two blocks to the right. Therefore, each of the blocks of the present embodiment are assigned the same number of pulses and pixels as a corresponding block in the previous embodiment. That is, in the previous embodiment, block 2 was a top surface of the waveform shape and was assigned 30 pulses (150 pixels). Therefore, in the present embodiment block 0, which is the top surface, also receives 30 pulses (150 pixels). Likewise, block 1 of the present embodiment corresponds to block 3 of the previous embodiment and receives 36 pulses (180 pixels), block 2 of the present embodiment corresponds to block 0 of the previous embodiment and receives 30 pulses (150 pixels), and block 3 of the previous embodiment corresponds to block 1 of the present embodiment and receives 36 pulses (180 pixels). Accordingly, the auto trigger count (ATTRGCNT) values for each of blocks 0 to 3 are set at 150, 180, 150 and 180, respectively, in the present embodiment.

Figure 24:
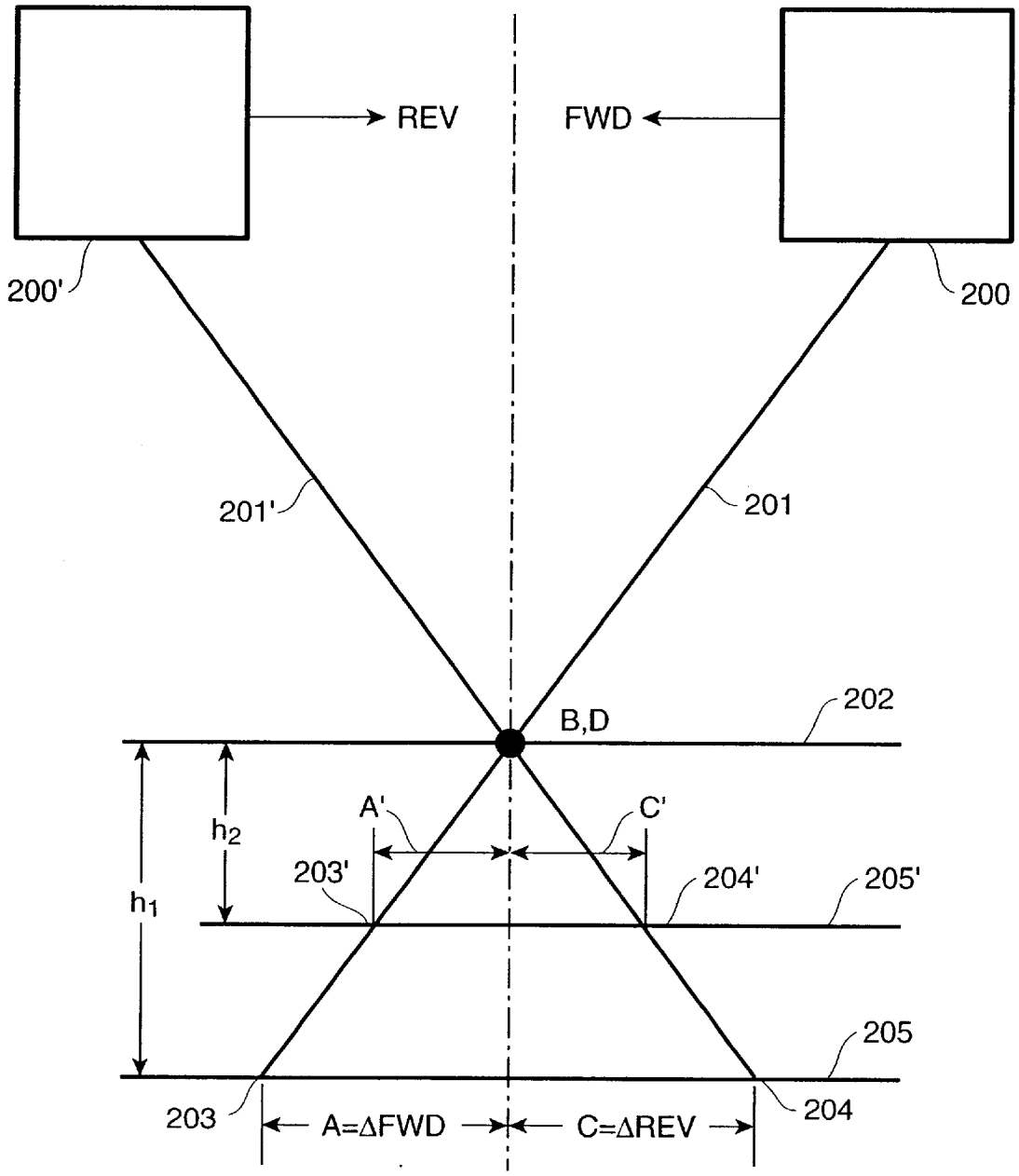
FIG. 24 is a diagram depicting variables utilized in the calculations of FIG. 25.

Since the reference surface has been changed from the bottom surface to the top surface, some adjustments are needed in the formulas depicted in FIG. 18. The adjusted formulas for the present embodiment are depicted in FIG. 25. FIG. 24 depicts a diagram of parameters utilized in the formulas of FIG. 25 for calculating the firing frequency and an auto trigger delay. In FIG. 24, reference number 200 represents a print head scanning in a forward direction and 200' represents the same print head scanning in a reverse direction. Reference numbers 202 and 205 represent the top and bottom surfaces, respectively, of the waveform shape of the paper, such as those portions shown in blocks 0 and 2, respectively, of FIG. 22. Print head 200 ejects an ink droplet along a trajectory 201 and print head 200' ejects an ink droplet along a trajectory 201'. In contrast to the previous embodiment, surface 202 is the reference surface for performing the calculations. As such, if print heads 200 and 200' were to eject ink droplets along trajectories 201 and 201' respectively, the ink droplets would contact the paper at points B and D, respectively. However, if print head 200 were to eject an ink droplet with the target contact point being point B, and the bottom of the waveform shape is within the trajectory path 201, the ink droplet will not contact the paper at point B, but will contact the paper at point 203.

As can be seen in FIG. 24, point 203 is offset a horizontal distance relative to point B by an amount A. Accordingly, in FIG. 24 and FIG. 25, the amount of offset for the forward scan of print head 200 is a value A (represented in FIG. 25 as ΔFWD). A similar calculation is performed for the reverse scan in order to adjust the nozzle firing of print head 200' an amount C (represented in FIG. 25 as ΔREV).

FIG. 25 is a table that summarizes the calculations for adjusting the firing frequency and the auto trigger delay for each of the blocks shown in FIG. 22. The formulas depicted in FIG. 25 are similar to those described above with regard to FIG. 18, but have been changed to reflect the change in the reference surface (block 0) from the bottom surface to the top surface.

The formulas depicted in FIG. 25 are utilized in the process steps of FIG. 19 in the same manner as described above with regard to the formulas of FIG. 18 and the process steps of FIG. 19. Additionally, the process steps are carried out in the autotrigger controller in the same manner as described above with regard to FIG. 20.

In yet another embodiment of the invention, adjustments may be made based on a type of recording medium. The previous two embodiments described adjustments in the autotrigger delay and firing frequency based on printing on plain paper. A case will now be described with regard to printing on high grade paper.

In the present embodiment, the cockling ribs 59 are spaced at the same spacing as the previous two embodiments, i.e. 132 carriage motor pulses. Accordingly, the description regarding FIG. 14 applies equally in the present embodiment. As such, the period of the waveform shape for high grade paper is the same as that for plain paper, i.e. 132 pulses. Again, the period of the paper is dictated by the cockling rib spacing and, although a 132 motor pulse spacing has been described herein, other spacings may be used to achieve an even higher image quality.

Figure 23:
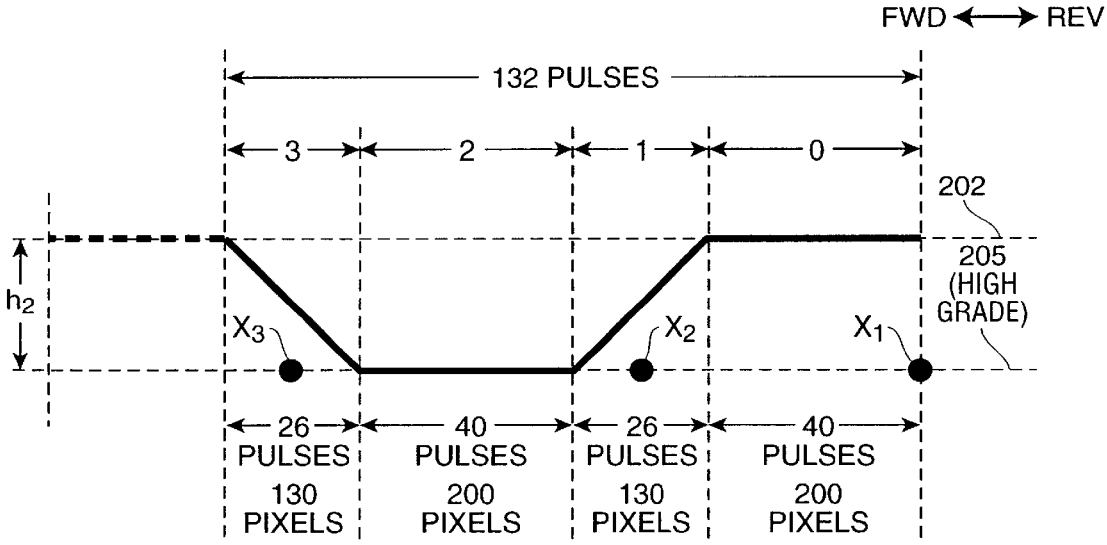
FIG. 23 is an enlarged detail view of a portion of FIG. 15 for a second embodiment of the invention utilizing high grade paper.

Similar to the previous two embodiments, the period is broken down into four blocks, blocks 0 to 3 respectively. However, the number of pulses assigned to each block of the present embodiment are different than the previous two embodiments. This is due to the fact that high grade paper is generally stiffer than plain paper. As such, although the cockling ribs are the same as those described above for plain paper, the height of the waveform shape is smaller for high grade paper than for plain paper. That is, $h_1$ of FIG. 22 (plain paper) is greater than $h_2$ of FIG. 23 (high grade paper). As a result, the top and bottom portions of the waveform shape tend to be larger for high grade paper than for plain paper, and proportionally, the ramp-up and ramp-down portions tend to be smaller. Therefore, as seen in FIG. 23, blocks 0 and 2 (top and bottom blocks, respectively) are each assigned 40 motor pulses (200 pixels), and blocks 1 and 3 (ramp-down and ramp-up, respectively, for a forward scan) are each assigned 26 pulses (130 pixels). These values are then utilized for the ATTRGCNT values of the process steps of FIG. 19.

Referring again to FIG. 24, reference number 205 is the bottom surface for plain paper and reference number 205' is the bottom surface for high grade paper. Surface 205 is located a distance $h_1$ from the top surface 202, whereas, surface 205' is located a distance $h_2$ from the top surface 202. As can be seen in FIG. 24, the offset distances A and C are smaller (shown as A' and C') due to the closer proximity of the bottom surface 205' to the print head. Accordingly, the values for A and C in the formulas of FIG. 25 are adjusted for the smaller offset distance and are changed from ±(0.5) pix to ±(0.2)pix.

Thus, for high grade paper, some of the values in the formulas of FIG. 25 are adjusted to compensate for the closer proximity of the paper bottom surface to the print head, and may be adjusted for the different block sizes as well. However, the process steps of FIG. 19 and the description with regard to FIG. 20 applies equally to the present embodiment as with the previous two embodiments.

The invention has been described with respect to particular illustrative embodiments. It is to be understood that the invention is not limited to the above-described embodiments and that various changes and modifications may be made by those of ordinary skill in the art without departing from the spirit and scope of the invention.

What is claimed is:

1. A printing method of a printing device in which a print head scans across a recording medium and ejects ink from a print head onto the recording medium, comprising the steps of:

inducing a predetermined unevenness pattern into the recording medium, which is to be compensated for by adjusting an ejection frequency of the print head;

adjusting an ink ejection frequency of the print head based on the induced unevenness pattern; and controlling ink ejection by the print head based on the adjusted frequency.

2. A method according to claim 1, wherein a first ink ejection in a scan of the print head is based on the adjusted frequency.

3. A method according to claim 1, wherein the printing device comprises a plurality of print heads and the ink ejection frequency is adjusted for each print head individually.

4. A method according to claim 1, wherein the printing device performs bi-directional printing and the ink ejection frequency is adjusted respectively for a forward printing scan and a reverse printing scan.

5. A method according to claim 1, wherein the ink ejection frequency is adjusted respectively for a carriage speed.

6. A method according to claim 1, wherein the printing device comprises a plurality of print heads, each of which are located with respect to each other along a scan direction corresponding to the induced unevenness pattern.

7. A method according to claim 1, wherein the printing device comprises a plurality of print heads each controlled by a same control signal.

8. A method according to claim 1, wherein the printing device comprises a plurality of print heads, at least one of which corresponds to print data having a first color and at least one of which corresponds to print data having a second color, wherein, in a case where print data of both the first and second colors are to be printed in a same scan, the ink ejection frequency of the at least one print head corresponding to print data having the second color is controlled, and wherein, in a case where only print data of the first color is to be printed in a same scan, the ink ejection frequency of the at least one print head corresponding to print data having the first color is controlled.

9. A method according to claim 1, wherein the adjustment of the ink ejection frequency includes an auto-alignment procedure.

10. A method according to claim 1, wherein parameters utilized for adjusting the ink ejection frequency are automatically set and override existing parameters based on a selected printing mode of the printing device.

11. An ink-jet printing apparatus, comprising:

a print head that scans across a recording medium and ejects ink onto the recording medium;

a mechanism for inducing a predetermined unevenness pattern into the recording medium at least in an area in which the print head scans across the recording medium, wherein the predetermined unevenness pattern to be compensated for by adjusting an ejection frequency of the print head;

a trigger mechanism for effecting ejection of the ink;

a device for determining an adjusted ink ejection frequency based on the induced predetermined unevenness pattern; and a controller for controlling the trigger mechanism to effect ink ejection at the adjusted ink ejection frequency.

12. An ink-jet printing apparatus according to claim 11, wherein a first ink ejection in a scan of the print head is based on the adjusted frequency.

13. An ink-jet printing apparatus according to claim 11 comprising a plurality of print heads wherein the adjusted ink ejection frequency is determined for each print head individually.

14. An ink-jet printing apparatus according to claim 11, wherein the print head performs bi-directional printing and the adjusted ink ejection frequency is determined respectively for a forward scan and a reverse scan.

15. An ink-jet printing apparatus according to claim 11 comprising a plurality of print heads, each of which are arranged in the apparatus with respect to each other in a scanning direction a distance corresponding to a period of the induced unevenness pattern.

16. An ink-jet printing apparatus according to claim 11 comprising a plurality of print heads each controlled by a same signal.

17. An ink-jet printing apparatus according to claim 11 comprising a plurality of print heads, at least one of which corresponds to print data having a first color and at least one of which corresponds to print data having a second color, wherein, in a case where print data of both the first and second colors are to be printed in a same scan, the adjusted ink ejection frequency is controlled for the print head corresponding print data having the second color, and wherein, in a case where only print data having the first color is to be printed in a same scan, the adjusted ink ejection frequency is controlled for the print head corresponding to print data of the first color.

18. An ink-jet printing apparatus according to claim 11 further comprising an auto-alignment device, wherein the adjusted ink ejection frequency is determined as part of an auto-alignment procedure.

19. An ink-jet printing apparatus according to claim 11, wherein parameters utilized in determining the adjusted ink ejection frequency are automatically set and override existing parameters based on a selected printing mode.

20. An ink-jet printing apparatus according to claim 11, wherein the adjusted ink ejection frequency is determined respectively for a carriage speed.

21. Computer executable process steps for controlling a printing operation of a printing device in which a print head scans across a recording medium and ejects ink from a print head onto the recording medium, comprising the steps of:

inducing a predetermined unevenness pattern into the recording medium, which is to compensated for by adjusting an ejection frequency of the print head;

adjusting an ink ejection frequency of the print head based on the induced unevenness pattern; and controlling ink ejection by the print head based on the adjusted frequency.

22. Computer executable process steps according to claim 21, wherein a first ink ejection in a scan of the print head is based on the adjusted frequency.

23. Computer executable process steps according to claim 21, wherein the printing device comprises a plurality of print heads and the ink ejection frequency is adjusted for each print head individually.

24. Computer executable process steps according to claim 21, wherein the printing device performs bi-directional printing and the ink ejection frequency is adjusted respectively for a forward printing scan and a reverse printing scan.

25. Computer executable process steps according to claim 21, wherein the ink ejection frequency is adjusted respectively for a carriage speed.

26. Computer executable process steps according to claim 21, wherein the printing device comprises a plurality of print heads, each of which are located with respect to each other along a scan direction corresponding to the induced unevenness pattern.

27. Computer executable process steps according to claim 21, wherein the printing device comprises a plurality of print heads each controlled by a same control signal.

28. Computer executable process steps according to claim 21, wherein the printing device comprises a plurality of print heads, at least one of which corresponds to print data having a first color and at least one of which corresponds to print data having a second color, wherein, in a case where print data of both the first and second colors are to be printed in a same scan, the ink ejection frequency of the at least one print head corresponding to print data having the second color is controlled, and wherein, in a case where only print data of the first color is to be printed in a same scan, the ink ejection frequency of the at least one print head corresponding to print data having the first color is controlled.

29. Computer executable process steps according to claim 21, wherein the adjustment of the ink ejection frequency includes an auto-alignment procedure.

30. Computer executable process steps according to claim 21, wherein parameters utilized for adjusting the ink ejection frequency are automatically set and override existing parameters based on a selected printing mode of the printing device.

31. A computer readable medium which stores executable process steps for controlling a printing operation of a printing device in which a print head scans across a recording medium and ejects ink from a print head onto the recording medium, the executable process steps comprising:

inducing a predetermined unevenness pattern into the recording medium, which is to compensated for by adjusting an ejection frequency of the print head;

adjusting an ink ejection frequency of the print head based on the induced unevenness pattern; and controlling ink ejection by the print head based on the adjusted frequency.

32. A computer readable medium according to claim 31, wherein a first ink ejection in a scan of the print head is based on the adjusted frequency.

33. A computer readable medium according to claim 31, wherein the printing device comprises a plurality of print heads and the ink ejection frequency is adjusted for each print head individually.

34. A computer readable medium according to claim 31, wherein the printing device performs bi-directional printing and the ink ejection frequency is adjusted respectively for a forward printing scan and a reverse printing scan.

35. A computer readable medium according to claim 31, wherein the ink ejection frequency is adjusted respectively for a carriage speed.

36. A computer readable medium according to claim 31, wherein the printing device comprises a plurality of print heads, each of which are located with respect to each other along a scan direction corresponding to the induced unevenness pattern.

37. A computer readable medium according to claim 31, wherein the printing device comprises a plurality of print heads each controlled by a same control signal.

38. A computer readable medium according to claim 31, wherein the printing device comprises a plurality of print heads, at least one of which corresponds to print data having a first color and at least one of which corresponds to print data having a second color, wherein, in a case where print data of both the first and second colors are to be printed in a same scan, the ink ejection frequency of the at least one print head corresponding to print data having the second color is controlled, and wherein, in a case where only print data of the first color is to be printed in a same scan, the ink ejection frequency of the at least one print head corresponding to print data having the first color is controlled.

39. A computer readable medium according to claim 31, wherein the adjustment of the ink ejection frequency includes an auto-alignment procedure.

40. A computer readable medium according to claim 31, wherein parameters utilized for adjusting the ink ejection frequency are automatically set and override existing parameters based on a selected printing mode of the printing device.

* * * * *

UNITED STATES PATENT AND TRADEMARK OFFICE

CERTIFICATE OF CORRECTION

PATENT NO. : 6,604,803 B1
DATED : August 12, 2003
INVENTOR(S) : Hanabusa et al.

It is certified that error appears in the above-identified patent and that said Letters Patent is hereby corrected as shown below:

Column 14,
Line 12, “31” should read -- 3, --; and
Line 24, “Block” should read -- block --.

Column 20,
Lines 5 and 61, “to” should read -- to be --.

Signed and Sealed this

Twenty-eighth Day of December, 2004

JON W. DUDAS
*Director of the United States Patent and Trademark Office*